US007972086B2

(12) United States Patent
Taylor

(10) Patent No.: US 7,972,086 B2
(45) Date of Patent: Jul. 5, 2011

(54) EARTHEN RETAINING WALL WITH PINLESS SOIL REINFORCING ELEMENTS

(75) Inventor: Thomas P. Taylor, Colleyville, TX (US)

(73) Assignee: T & B Structural Systems, LLC, Fort Worth, TX (US)

( * ) Notice: Subject to any disclaimer, the term of this patent is extended or adjusted under 35 U.S.C. 154(b) by 812 days.

(21) Appl. No.: 11/775,072

(22) Filed: Jul. 9, 2007

(65) Prior Publication Data

US 2009/0016825 A1 Jan. 15, 2009

(51) Int. Cl.
*E02D 17/20* (2006.01)

(52) U.S. Cl. ..... 405/284; 405/302.7

(58) Field of Classification Search ..... 405/284, 405/302.7, 262, 287, 302.4
See application file for complete search history.

(56) References Cited

U.S. PATENT DOCUMENTS

| | | | | | |
|---|---|---|---|---|---|
| 4,391,557 | A * | 7/1983 | Hilfiker et al. | ..... | 405/287 |
| 4,856,939 | A * | 8/1989 | Hilfiker | ..... | 405/284 |
| 5,156,496 | A * | 10/1992 | Vidal et al. | ..... | 405/262 |
| 5,494,379 | A * | 2/1996 | Anderson et al. | ..... | 405/262 |
| 5,531,547 | A * | 7/1996 | Shimada | ..... | 405/262 |
| 5,622,455 | A * | 4/1997 | Anderson et al. | ..... | 405/262 |
| 5,722,799 | A * | 3/1998 | Hilfiker | ..... | 405/262 |
| 5,730,559 | A * | 3/1998 | Anderson et al. | ..... | 405/284 |
| 5,733,072 | A * | 3/1998 | Hilfiker et al. | ..... | 405/284 |
| 5,749,680 | A * | 5/1998 | Hilfiker et al. | ..... | 405/262 |
| 5,797,706 | A * | 8/1998 | Segrestin et al. | ..... | 405/262 |
| 5,947,643 | A * | 9/1999 | Anderson et al. | ..... | 405/262 |
| 5,951,209 | A * | 9/1999 | Anderson et al. | ..... | 405/262 |
| 6,086,288 | A * | 7/2000 | Ruel et al. | ..... | 405/262 |
| 6,345,934 | B1 * | 2/2002 | Jailloux et al. | ..... | 405/262 |
| 6,357,970 | B1 * | 3/2002 | Hilfiker et al. | ..... | 405/302.7 |
| 6,857,823 | B1 * | 2/2005 | Hilfiker et al. | ..... | 405/262 |
| 7,033,118 | B2 * | 4/2006 | Hilfiker | ..... | 405/262 |
| 7,073,983 | B2 * | 7/2006 | Hilfiker et al. | ..... | 405/262 |
| 7,281,882 | B2 * | 10/2007 | Hilfiker et al. | ..... | 405/262 |
| 7,399,144 | B2 * | 7/2008 | Kallen | ..... | 405/284 |
| 2005/0163574 | A1 * | 7/2005 | Hilfiker et al. | ..... | 405/262 |
| 2005/0271478 | A1 * | 12/2005 | Ferraiolo | ..... | 405/284 |
| 2005/0286981 | A1 * | 12/2005 | Robertson et al. | ..... | 405/284 |
| 2006/0239783 | A1 * | 10/2006 | Kallen | ..... | 405/284 |

* cited by examiner

*Primary Examiner* — Tara Mayo-Pinnock
(74) *Attorney, Agent, or Firm* — Edmonds & Nolte, PC

(57) ABSTRACT

An earthen retaining wall constructed with welded wire grid includes a series of soil reinforcing elements and separate facing panels with distal ends is provided. Soil reinforcing transverse elements capture the distal ends of the facing panel on both the front face side and the back face side. Capturing the distal ends on both the front side and back side horizontally secures the reinforcing elements without the aid of secondary connectors such as hog-rings, tie wires, connection pins, or other supplemental connectors. The soil reinforcing elements are free to move in the vertical direction but not in the horizontal direction.

18 Claims, 22 Drawing Sheets

EARTHEN RETAINING WALL WITH PINLESS SOIL REINFORCING ELEMENTS

BACKGROUND

In current welded wire wall systems that use welded wire mesh with soil reinforcing comprising a horizontal floor portion, upright portions connect a facing panel together with a connection pin, tie wire, or hog rings. In certain of these systems, upwardly extending soil reinforcing elements have a series of kinks placed in them through which a connection pin is passed for connecting the facing panel to the soil reinforcing elements. The upwardly extending portions of the soil reinforcing elements in conjunction with the connection pin add steel to the earthen formation and increase the overall cost of the components.

Retaining wall structures that use horizontally positioned soil inclusions to reinforce the earth mass in combination with a facing element are referred to as Mechanically Stabilized Earth (MSE) structures. In MSE retaining walls, the size of the soil reinforcing wire diameter is dependent on the height of the wall and externally applied loads. As the wall height increases, the loads that are required to be resisted by the soil reinforcing elements are increased which in turn increases the requisite wire diameter of the soil reinforcing elements. As a rule of thumb, larger diameter soil reinforcing wire is placed in the bottom of the wall and smaller diameter soil reinforcing wire is used at the top of the wall. It is well known that the facing panel does not provide structural support of the MSE retaining wall, but rather the facing panel is used to prevent the soil disposed between soil reinforcing elements from raveling out of the face of the wall.

In systems that use soil reinforcing structures with upright portions and in systems that use soil reinforcing structures with an upwardly extending facing panel, upright portions are an integral part of the soil-reinforcing structure. Vertical wires of an upright portion and horizontal soil reinforcing wires are components of the same element. As the size of the soil reinforcing wire diameter increases, so does the size of the upright portions. Although the face panel does not structurally contribute to soil reinforcement, the wire diameter in the face panel is increased relative to the height of the wall system thus increasing the steel weight and subsequent cost of the wall system. A decrease in the overall cost of the wall system without changing the structural integrity of the MSE retaining wall may be realized by eliminating the upright portions of the soil reinforcing element and incorporating a separate facing element.

MSE retaining walls having separate face panels may advantageously be manufactured in various configurations allowing for different apparent, or accessible, openings at the face of the wall thereby allowing for the use of different sized, or granularity, backfill. Conventional MSE retaining wall systems that use upwardly extending L-type soil-reinforcing elements may feature a backing panel that is placed behind the upwardly extending soil reinforcing element or the facing panel. In these systems, the backing panel is used to decrease the accessible opening at the face of the wall to supplement the large accessible opening of the upwardly extending facing panel. The inclusion of a backing panel requires an additional fabrication step, additional material that must be shipped to the project, and an additional labor step in the erection of the earthen structure. Moreover, the inclusion of a backing panel increases the requisite steel weight of the MSE system. These manufacturing steps and material disadvantageously add to the MSE system weight, materials cost, and construction cost.

In MSE retaining wall design, the tributary area used to calculate the resistance of any soil reinforcing determined by assuming that the soil reinforcing element is located in the center of a three-dimensional volume of soil. The tributary of soil for this soil-reinforcing element is decreased by 50% when the soil reinforcing is placed on the foundation. In earthen retaining walls that use upwardly extending soil reinforcing elements, the bottom soil-reinforcing element has to be placed on the foundation, or separate elements have to be fabricated to move the soil-reinforcing element from the foundation.

BRIEF DESCRIPTION OF THE DRAWINGS

Aspects of the present disclosure are best understood from the following detailed description when read with the accompanying figures, in which.

DETAILED DESCRIPTION

Figure 1:
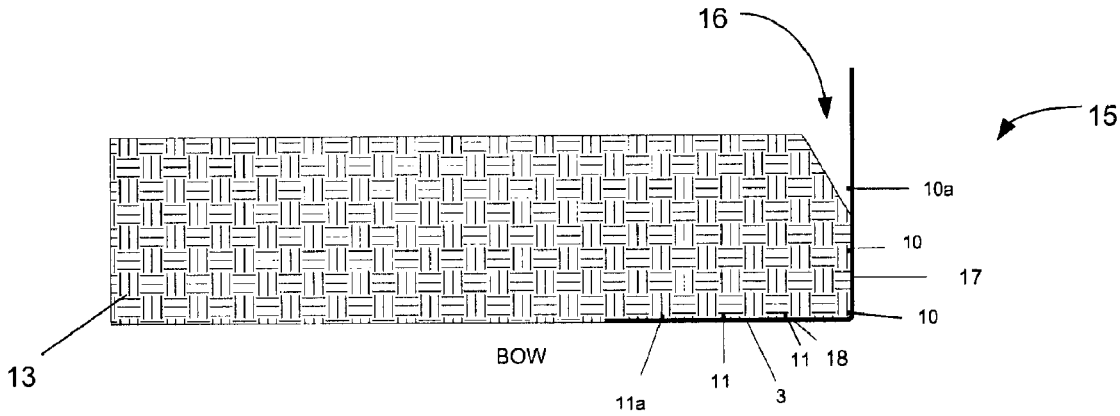
FIG. 1 is a diagrammatic illustration of an initial step of construction of a mechanically stabilized earth structure implemented in accordance with embodiments.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Embodiments described herein provide for soil reinforcement that is moved off of the foundation by bending the facing panel to approximately a 90° angle about the midpoint of the facing panel. The same facing panel is used so no additional manufacturing is required in producing the wire. In addition, by moving the soil reinforcement from the foundation, the full structural capabilities of the soil reinforcement are relied on thereby advantageously decreasing the steel weight of the wall and the cost of the wall.

Embodiments provided herein provide reinforcing structures that use fewer parts and decrease fabrication time, shipping costs, and material costs.

A principal objective of embodiments described herein is to provide a method of constructing an earthen formation with welded wire grid work that includes a series of soil reinforcing elements and separate facing panels with distal ends. Soil reinforcing transverse elements capture the distal ends of the facing panel on both the front face side and the back face side. Capturing the distal ends on both the front side and back side horizontally secures the reinforcing elements without the aid of secondary connectors such as hog-rings, tie wires, connection pins, or other supplemental connectors. The soil reinforcing elements are free to move in the vertical direction but not in the horizontal direction.

A second objective of the embodiments described herein is to limit the number of fabricated pieces by:

1. Eliminating the need to connect the soil reinforcing elements to the facing panel with secondary connectors, such as, but not limited to, a hog-ring, tie wire, or connection pin;
2. Eliminating the need to have a second facing panel (sometimes referred to as a backing panel) positioned behind the facing panel;
3. Decreasing the overall welded wire structure steel weight by having a uniform facing panel that is used at all locations of the structure;
4. Permitting a variable horizontal center-to-center spacing of soil-reinforcing elements;
5. Permitting a variable vertical center-to-center spacing of soil-reinforcing elements;
6. Permitting soil-reinforcing elements with variable spaced longitudinal wires that may range from, but are not limited to, a center-to-center spacing of 4" to 12"; and
7. Permitting placement and ordination of the facing panel in reference to the soil reinforcing element.

A third objective of the embodiments described herein is to dispose a bottom most soil reinforcing element to an elevation above the foundation (as opposed to locating the bottom most soil reinforcing element on the foundation as is conventional) equal to approximately one-half the center-to-center spacing of soil reinforcing elements. As referred to herein, a "center-to-center" spacing refers to the vertical distance between adjacent or sequential soil reinforcing elements of a soil reinforcing system or structure. The center-to-center spacing is illustratively designated in various Figures as a distance "Y". In one embodiment, a bottom facing panel is fabricated from the same intermediate facing panel by folding the facing panel approximately at its' midpoint. By disposing the soil reinforcing off the foundation, a decrease in the overall weight of the structure is had by advantageously exploiting the full structural capacity of each soil-reinforcing element. By using a common facing element as the bottom facing panel, the manufacture of a different facing element is avoided. The bend angle of the bottom facing panel can vary from approximately 15 degrees to 90 degrees. The amount of excavation and the amount of backfill in the earthen formation is decreased by disposing the soil reinforcing element off of the foundation and by utilizing a facing panel with a small horizontally extending leg.

In accordance with embodiments described herein, mechanically stabilized earth wall components comprise welded wire grid works. Welded wire grid soil-reinforcing elements respectively comprise a horizontally positioned component that is buried in the soil in a substantially horizontal alignment at spaced relationships to one another in combination with a welded wire grid facing component that may be placed against compacted soil in a substantially vertical alignment. The soil-reinforcing component adds tensile capacity to the earthen formation. The facing components prevent raveling or displacement of the soil between successive layers of soil reinforcing elements. A soil-reinforcing element is manufactured with a downwardly facing portion with a transverse element of the grid that is placed on the front side and a transverse element that is placed on the back side of the facing element to prevent the soil reinforcing element from being able to translate in a horizontal direction while allowing it to translate in a vertical direction.

The vertical welded wire grid facing section defines the face of the earthen formation. The welded wire mesh facing section is manufactured with a series of vertical wires and a series of cross wires welded at intersections thereof. The cross wires are positioned on the vertical wires in such a manner so the vertical wires have distal ends that extend past the first and last cross wires. The overall dimension from the bottom most cross wire to the top most cross wire is less than the distance of the center-to-center spacing of the soil reinforcing components when positioned in the earth mass. The top most cross wire in relation to the horizontally positioned soil-reinforcing element is a distance "X" below the elevation of the next row of soil reinforcing elements. This distance "X" is defined as the distance of allowable consolidation, compression, or settlement of the earthen mass between horizontal soil reinforcing elements. The top distal end of the facing panel at approximately the distance "X" may have the remaining end portion bent toward the reinforced volume in order to provide a guide marker for placement of the soil reinforcing element. This bend can vary in the angle degree and may be a small kink on the wire.

In a preferred embodiment, the lead end of the soil-reinforcing element is fabricated with a lead transverse element and a next transverse element. The distance between the lead transverse element and the next transverse element is a function of the spacing of the cross elements of the facing panel. The lead end of the soil reinforcing element is folded at the location of the next transverse element to produce a downwardly projected section. The angle of the bend is such that the top distal ends of the facing panel is allowed to be placed through the downwardly projected section of the soil reinforcing element so the distal end is on the back side of the lead transverse wire of the soil reinforcing element and in front of the next transverse wire of the facing panel. The lead transverse wire is positioned so it aligns approximately parallel to the top most transverse element of the face panel below. As the bent down portion is placed over the distal ends of the facing panel, both transverse wires are in contact with the vertically extending wire.

In a second embodiment, the soil-reinforcing element is fabricated with a lead transverse element and a next transverse element that are spaced a distance approximately equal to the diameter of the vertical facing panel wire and the diameter of the transverse facing panel wire. This space of the lead transverse element and the next transverse element is positioned in such a manner that the facing panel distal ends of both the upper and lower section can be placed through the opening, and the bottom most transverse wire of the facing panel above can be placed between both the lead transverse wire of the soil reinforcing element and the next transverse wire of the soil reinforcing element to prevent the facing panel from moving in a horizontal direction.

In yet another embodiment, the lead end of the soil-reinforcing element is fabricated with a lead transverse element and a next transverse element. The distance between the lead transverse element and the next transverse element is a function of the spacing of the cross elements of the facing panel. The lead end of the soil reinforcing element is folded at the location of the next transverse element to produce an upwardly projected section. The angle of the fold is such that it allows the top distal ends of the facing panel to be placed through the upwardly projected section of the soil reinforcing element so the distal end is disposed on or abuts the back side of the lead transverse wire of the soil reinforcing element and is disposed in front of the next transverse wire of the facing panel. The lead transverse wire is positioned so it abuts with the top distal ends of the facing panel below. As the bent down portion is placed over the distal ends of the facing panel, both transverse wires are in contact with the vertically extending wire.

Construction of the mechanically stabilized earth structure is a repetitive process and may be implemented according to the following steps as shown and described in accordance with a preferred embodiment.

FIG. 1 is a diagrammatic illustration of an initial step of construction of a mechanically stabilized earth (MSE) structure implemented in accordance with embodiments. A bottom facing element is fabricated into an L-shape component 15 that is placed on a prepared foundation. L-shape component 15 comprises a facing panel (BFP) 17 and a soil-reinforcing element (BSR) 18. Backfill 13 is then placed and compacted to an elevation of the required spacing of the first soil-reinforcing element. A slight wedge shaped void 16 may be left at a back, or interior, face of face panel 17.

BFP 17 is fabricated with welded wire mesh comprising cross wires (CWs) 10 that include a top cross wire 10*a* and vertical wires (not shown). CWs 10 and 10*a* and the vertical wires (VWs) are mechanically welded to each other at intersecting points thereof. BSR 18 is fabricated with a welded wire mesh comprising longitudinal wires (LWs) 3 and transverse wires (TWs) 11 that include a last transverse wire 11*a* mechanically welded at intersecting points thereof.

Figure 2:
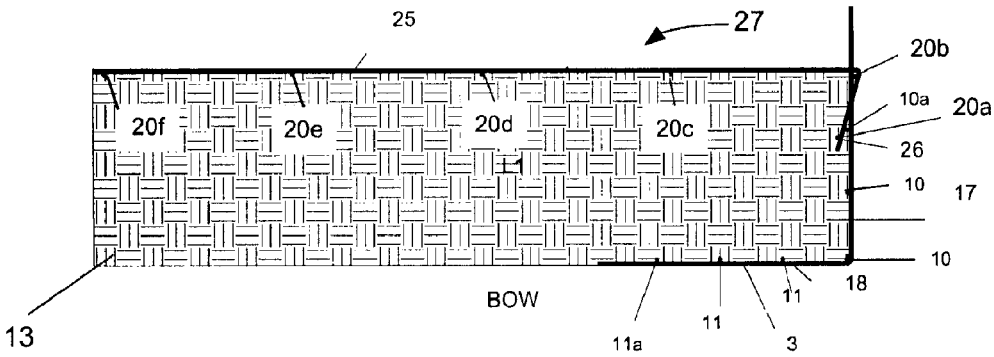
FIG. 2 is a diagrammatic illustration of placement of a soil reinforcing element during fabrication of a mechanically stabilized earth structure implemented in accordance with an embodiment.

FIG. 2 is a diagrammatic illustration of placement of a soil reinforcing element 25 during fabrication of an MSE implemented in accordance with an embodiment. Soil-reinforcing element (SR) 25 that comprises a horizontal soil reinforcing section 27 connected or otherwise integrated with a downwardly projecting section (PRSR) 26 is placed over distal ends of BFP 17 disposed therebelow. SR 25 includes a plurality of transverse wires 20*a*-20*f* including a lead transverse wire 20*a* and a succeeding transverse wire 20*b*. Lead transverse wire 20*a* is located more proximate to an end of PRSR 26 than succeeding wire 20*b*. The distal ends of BFP 17 are placed through PRSR 26 so lead transverse wire 20*a* is disposed at the back, or interior, face of BFP 17. Succeeding transverse wire 20*b* is placed at the front, or exterior, face of the distally extending ends of BFP 17. Horizontal section 27 of SR 25 is completely supported on backfill 13 and is not in contact with any cross element of BFP 17 disposed therebelow. Backfill 13 supports SR 25 such that horizontal section 27 of SR 25 does not bear on BFP 17 therebelow. The above-described assembly steps may be repeated until the top of the structure elevation is reached.

Figure 3:
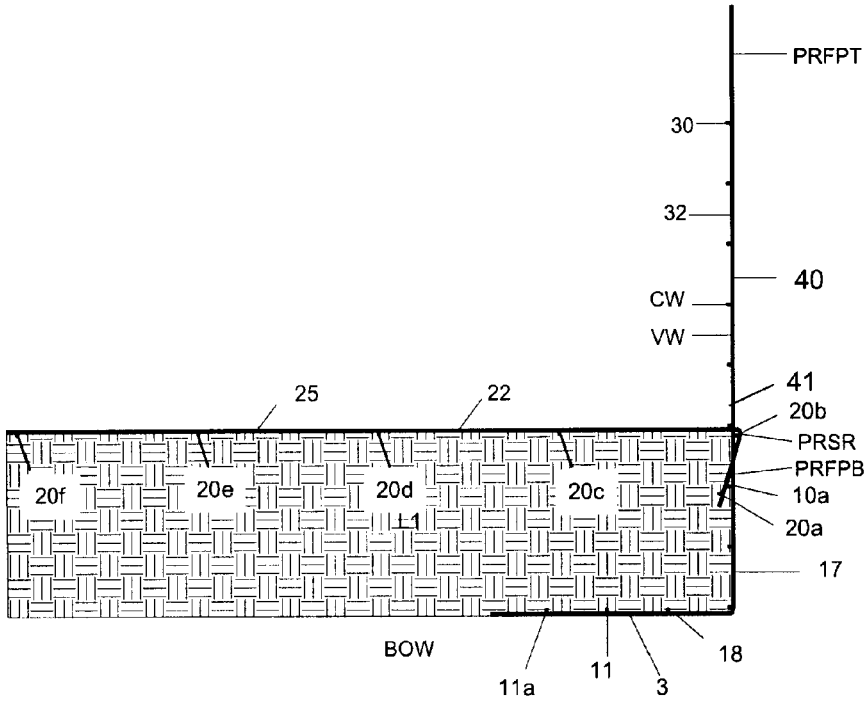
FIG. 3 is a diagrammatic representation of a mechanically stabilized earth structure construction configuration including assemblage of a facing panel in the structure.

FIG. 3 is a diagrammatic representation of a MSE construction configuration including assemblage of a facing panel 40 in the MSE structure. Facing panel 40 is placed in the MSE structure by passing downwardly projecting distal ends 41 behind transverse wire 20*b* of SR 25 that is positioned at the external surface of BFP 17 and in front of cross wire 10*a* of BFP 17. That is, facing panel 40 is assembled into the MSE such that distal ends 41 interpose succeeding transverse wire 20*b* of SR 25 and top-most CW 10*a* of BFP 17. This captures facing panel 40 into the final configuration and allows the bottom most transverse wire of facing panel 40 to bear on the longitudinal wires of SR 25.

Figure 4:
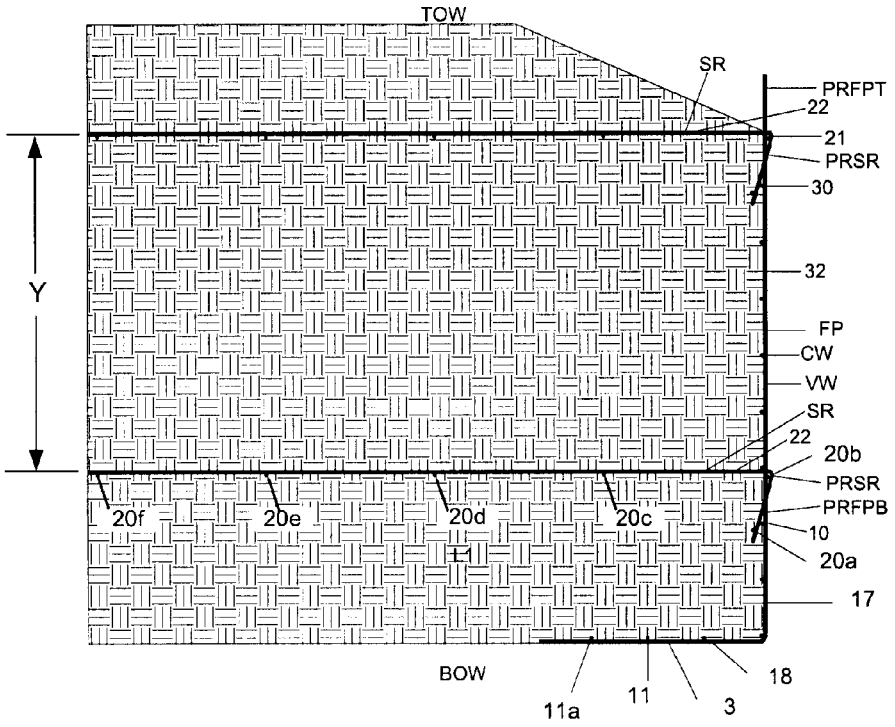
FIG. 4 is a diagrammatic representation of a final assembly step in the mechanically stabilized earth structure construction process that includes the placement of cap mats on the structure.

FIG. 4 is a diagrammatic representation of a final assembly step in the MSE construction process that includes the placement of cap mats on the structure. The cap mats comprise horizontal welded wire mesh elements. The cap mats are placed over distal ends of the BFPs of the top-most L-shaped elements. The cap mats may or may not be in contact with the cross wire of the upper most face panel(s).

Figure 5:
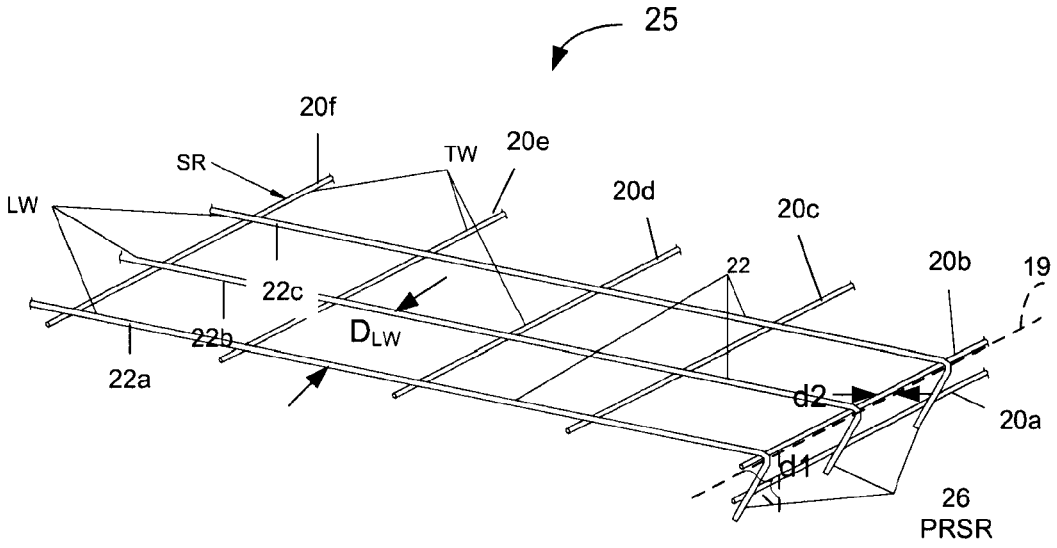
FIG. 5 is an isometric view of an embodiment of a soil-reinforcing element.

FIG. 5 is an isometric view of an embodiment of soil-reinforcing element 25. SR 25 may be fabricated of welded wire mesh comprising longitudinal wires (LWs) 22*a*-22*c* (collectively referred to herein as LWs 22) and transverse wires (TWs) 20*a*-20*f* (collectively referred to herein as TWs 20) mechanically welded to each other at their intersecting points. LWs 22 are substantially perpendicular to the face of the earthen formation and the TWs 20 are substantially parallel to the face of the earthen formation. The welded wire mesh preferably comprises at least two longitudinal wires and may comprise many longitudinal wires. The number of LWs used for fabricating SR 25 is dependent on fabricating tolerances of the wire manufacturer. The preferred spacing, $D_{LW}$, of adjacent longitudinal wires, such as the spacing between LWs 22*a* and 22*b*, is approximately 8" but can vary depending on the earthen structure use. SR 25 includes lead transverse wire designated as 20*a* and succeeding transverse wire 20*b*. The preferred distance between transverse wires 20*a* and 20*b* is approximately 4" but may be adjusted depending on the backfill compressibility and the length of upwardly extending prongs of the facing panel disposed below SR 25. An anterior section of SR 25 is folded downward at approximately the location of succeeding transverse wire 20*b* at an angle between 0° and 180° to form downwardly projection section (PRSR) 26. The preferred angle is an angle that sets lead transverse wire 20*a* radially disposed a distance d1 from anterior axis 19 greater than the radial displacement d2 from anterior axis 19 of succeeding transverse wire (20*b*).

Figure 6:
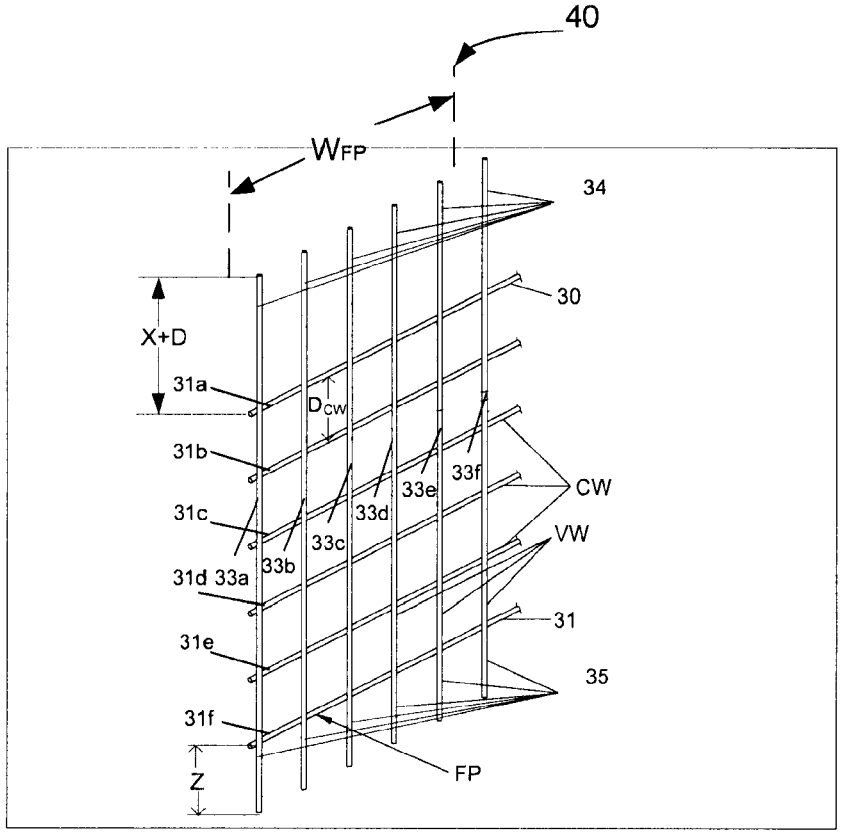
FIG. 6 is an isometric view of an embodiment of a facing panel.
Figure 7:
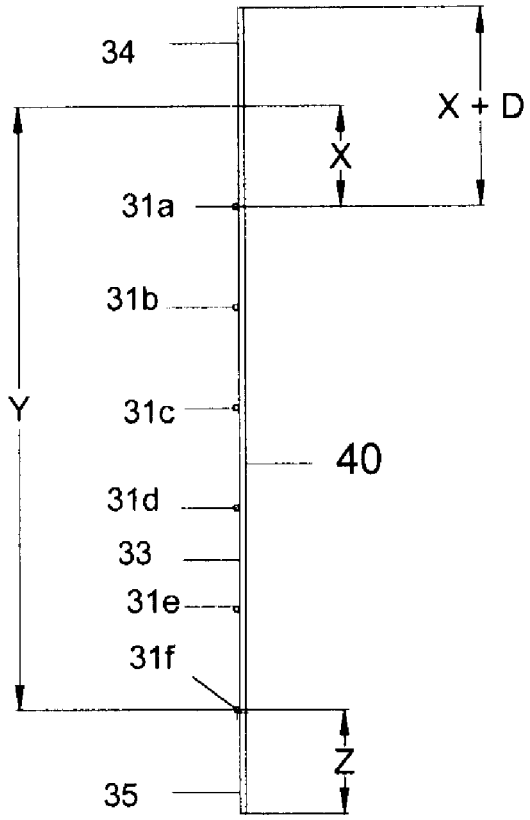
FIG. 7 is a side view of the facing panel shown in FIG. 6.

FIG. 6 is an isometric view of an embodiment of facing panel 40, and FIG. 7 is a side view of facing panel 40 shown in FIG. 6. Facing panel 40 comprises welded wire mesh with vertical wires (VWs) 33*a*-33*f* (collectively referred to as vertical wires 33) and cross wires (CWs) 31*a*-31*f* (collectively referred to as cross wires 31) that are mechanically welded to each other at their intersecting points. A preferred width, $W_{FP}$, of facing panel 40 is larger than the preferred width of one soil-reinforcing element by a distance of the spacing of the longitudinal wires (LW) of soil reinforcing element 25. The facing panel width $W_{FP}$ may be such that several soil-reinforcing elements may be attached thereto. Typically, the facing panel's vertical wires 33 and cross wires 31 are uniformly spaced but may be of any spacing desired. FP cross wires 31 include a top cross wire 31*a*, and a bottom cross wire 31*f*. At least one vertical wire is disposed perpendicularly between the top cross wire 31*a* and bottom cross wire 31*f*. Located above the top cross wire 31*a* are upwardly extending prongs (PR1) 34 that comprise respective sections of VWs 33 that extend vertically past top cross wire 31*a*. The length of prongs 34 is designated as "X+D," where X is the distance from the top cross wire 31*a* to the location where SR 25 is attached, and the distance D is the distance that the prongs 34 will reach into another facing panel disposed thereabove. The distance D may be slightly larger than the distance of the center-to-center spacing, $D_{CW}$, of cross wires 31). A distance, Y, defines the center-to-center spacing of the soil reinforcing element. Located below bottom cross wire 31*f* are downwardly extending prongs (PR2) 35 that comprise respective sections of VWs 33 that extend vertically below bottom cross wire 31*f* and comprise a length, Z. The prong 35 length Z is the distance that prongs 35 will reach into a facing panel disposed therebelow and may be slightly larger than the distance of the spacing, $D_{CW}$, of cross wires 31.

Figure 8:
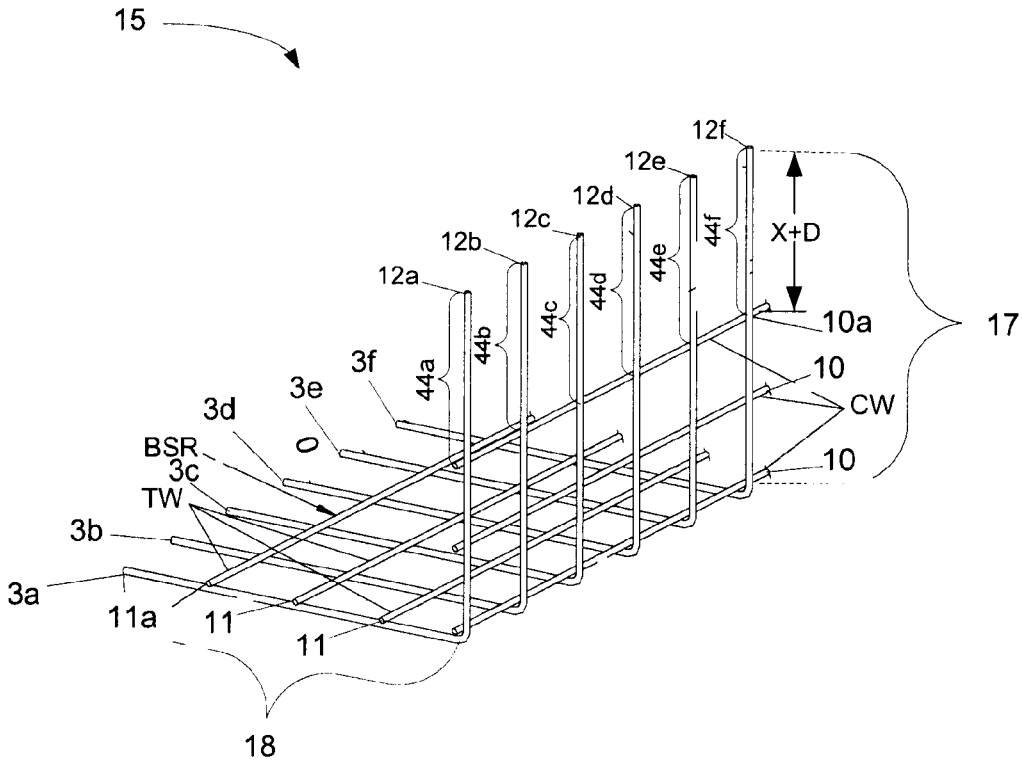
FIG. 8 is an isometric view of an embodiment of L-shaped component that comprises a bottom facing panel and bottom soil-reinforcing element.
Figure 9:
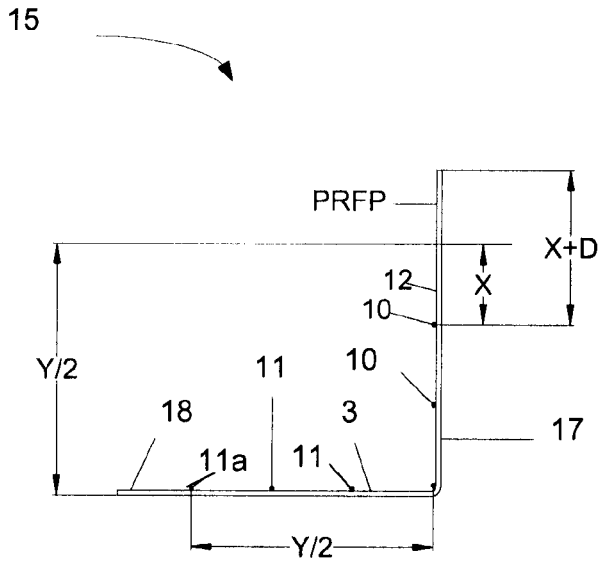
FIG. 9 is a side view of the L-shaped component depicted in FIG. 8.

FIG. 8 is an isometric view of an embodiment of L-shaped component 15 that comprises bottom facing panel (BFP) 17 and bottom soil-reinforcing element (BSR) 18, and FIG. 9 is a side view of L-shaped component 15. L-shaped component 15 may be placed at the base of an earthen formation (FD) in accordance with an embodiment. Bottom facing panel 17 is fabricated from a standard facing panel, e.g., facing panel 40 shown and described above in FIGS. 6 and 7, by bending it approximately at a midpoint to an angle approximately equal to the face of the earthen structure. The resulting L-shaped component 15 comprises a vertical portion designated the bottom facing panel 17 and a horizontal portion designated the bottom soil-reinforcing element (BSR) 18. The first soil-reinforcing element (SR) is attached to bottom facing panel 18 at a distance, Y/2, above the foundation approximately equal to one half of the center-to-center spacing of the soil reinforcing elements in the earthen formation. Bottom facing panel 17 is fabricated of welded wire mesh with vertical wires (VW) 12*a*-12*f* (collectively referred to as vertical wires 12) and cross wires (CWs) 10 and 10*a* (collectively referred to as cross wires 10) which are mechanically welded to each other at their intersecting points. At the bend location, the vertical wires of the facing panel are then configured as longitudinal wires and the cross wires of the facing panel are configured as transverse wires of the newly formed L-shaped component. The vertical wires (VW/LW) and cross wires (CW/TW) of L-shaped segment 15 are typically uniformly spaced. A top cross wire is designated top cross wire 10*a*, and a bottom soil reinforcing last transverse wire is designated as last transverse wire 11*a*. Vertical wires 12*a*-12*f* are spaced perpendicularly to top cross wire 10*a*, and longitudinal wires 3*a*-3*f* (collectively referred to as longitudinal wires 3) are spaced perpendicularly to last transverse wire 11*a*. It should be noted that vertical wires 12*a*-12*f* and corresponding longitudinal wires 3*a*-3*f* are preferably comprised of respective single wire elements. For example, vertical wire 12*a* and longitudinal wire 3*a* may be formed from a single vertical wire (e.g., vertical wire 33*a*) of a normal facing panel, such as facing panel 40 shown and described in FIG. 6. Thus, reference to longitudinal wires 3 and vertical wires 12 of BSR 18 is made as reference to the wire configuration to facilitate an understanding of the invention, and it is understood that a longitudinal wire and a vertical wire of a bottom soil reinforcing element may be fabricated from a single wire element. Furthermore, a longitudinal wire and a corresponding vertical wire of a BSR may be implemented as a single wire element each comprising a constituent component respectively configured in a soil-reinforcing component of the BSR and a facing panel of the BSR. Located above top cross wire 10*a* are upwardly extending prongs (PRFP) 44*a*-44*f* (collectively referred to as PRFPs 44). Respective lengths of PRFPs are designated as "X+D", where X is the distance from top cross wire 10*a* to the location where a soil-reinforcing element of a next layer of the MSE is attached above BFP 17. The distance D is the distance that prongs 44 will respectively extend into the facing panel of the next layer of the MSE attached above BFP 17 and may be slightly larger than the distance of the center-to-center spacing of cross wires 10 and 10*a*CW. A distance, Y/2, is the distance from the foundation of the earthen formation to the first, or bottom most soil-reinforcing element, e.g., BSR 18. Extending into the earthen formation past the last cross wire 11*a* are prongs of BSR 18 formed from the extension of respective longitudinal wires 3*a*-3*f* past last cross wire 11*a*. The length of the BSR prongs may be approximately Z as defined in the facing panel description above with reference to FIGS. 6 and 7.

Figure 10:
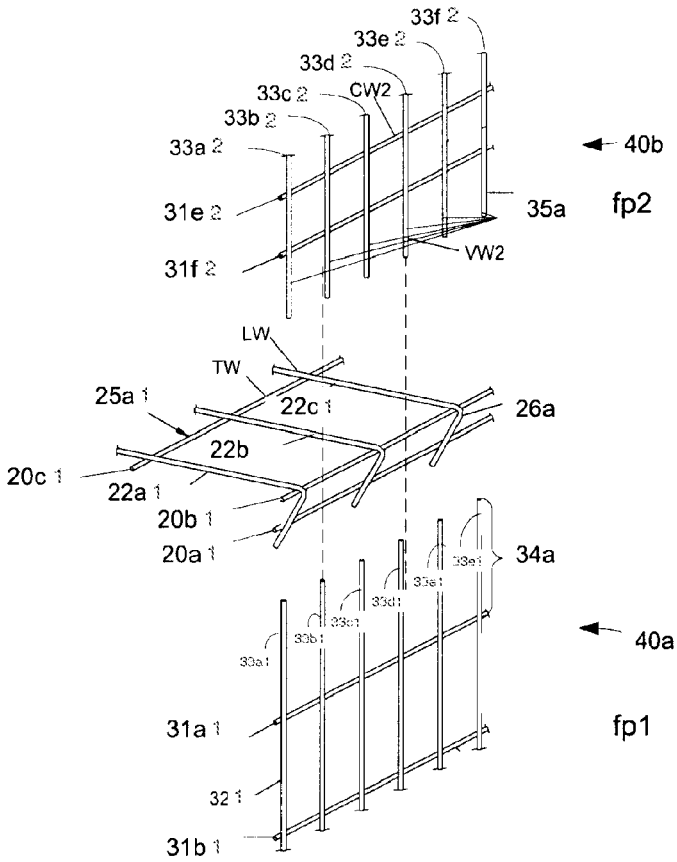
FIG. 10 is an exploded isometric view of an embodiment of a mechanically stabilized earth structure assemblage.
Figure 11:
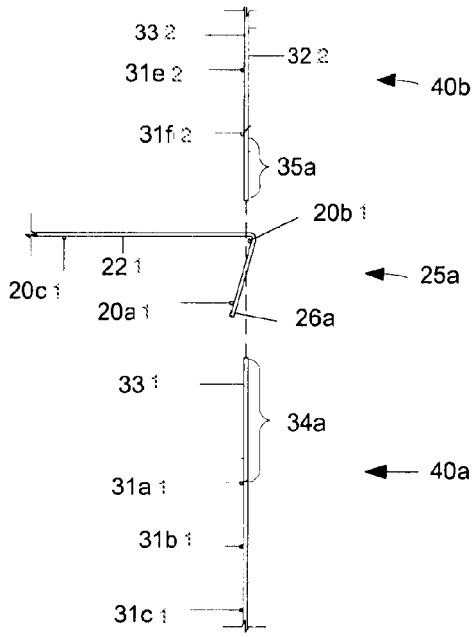
FIG. 11 is an exploded side view of the assemblage depicted in FIG. 10.
Figure 12:
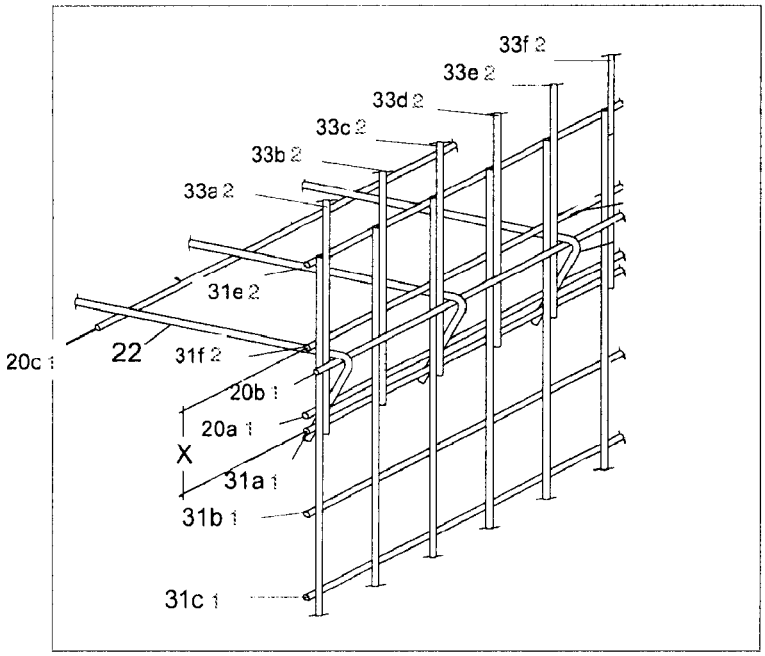
FIG. 12 is an isometric view of an embodiment of a completed mechanically stabilized earth structure assemblage.
Figure 13:
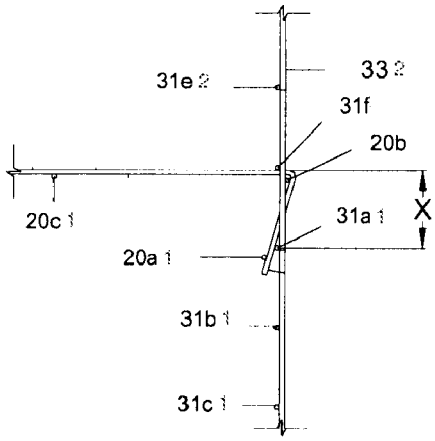
FIG. 13 is a side view of the completed assemblage of the mechanically stabilized earth structure depicted in FIG. 12.

FIG. 10 is an exploded isometric view of an embodiment of MSE assemblage, FIG. 11 is an exploded side view of the MSE assemblage depicted in FIG. 10, FIG. 12 is an isometric view of a completed MSE assemblage, and FIG. 13 is a side view of the completed assemblage of the MSE. FIGS. 10-13 show the connection of the two intermediate facing panels 40*a* and 40*b* to an intermediate soil-reinforcing element 25*a*. A downwardly projecting section 26*a* is placed over distal ends of upwardly extending prongs 34*a* of lower intermediate facing panel 40*a*. A lead transverse wire 20*a*1 of soil reinforcing element 25*a* is placed behind upwardly projecting prong 34*a* of the lower facing panel 40*a*, and next transverse wire 20*b*1 of soil reinforcing element 25*a* is placed in front of upwardly projecting prongs 34*a* of the lower facing panel 40*a*. That is, upwardly projecting prongs 34*a* are interposed between lead transverse wire 20*a*1 and next transverse wire 20*b*1. Lead transverse wire 20*a*1 of soil reinforcing element 25*a* may be forced down upwardly projecting prongs 34*a* such that the distal ends of upwardly projecting prongs 34*a* are configured at approximately the same elevation as a first cross wire 31*a*1 of facing panel 40*a* and longitudinal wires 22*a*1-22*c*1 rests on the backfill at the elevation of the center-to-center spacing of soil reinforcing element 25*a*. Facing panel 40*b* disposed above soil reinforcing element 25*a* is connected to soil reinforcing element 25*a* by passing downwardly projecting prongs 35*a* so it is interposed with lead transverse wire 20*a*1 and next transverse wire 20*b*1. For example, downwardly projecting prongs 35*a* may be configured to be positioned behind lead transverse wire 20*a*1 and in front of next transverse wire 20*b*1. Additionally, downwardly projecting prongs 35*a* may be positioned in front of facing panel 40*a* cross wire 31*a*1. A lower-most cross wire 31*f*2 of facing panel 40*b* disposed above soil reinforcing element 25*a* abuts and rests on longitudinal wires 22*a*1-22*c*1 of soil reinforcing element 25*a*. The position of the vertical wires 33*a*1-33*f*1 (collectively referred to as vertical wires 331) of facing panel 40*a* and vertical wires 33*a*2-33*f*2 (collectively referred to as vertical wires 332) of facing panel 40*b* is such that upwardly extending prongs 34*a* of facing panel 40*a* and downwardly extending prongs 35*a* of facing panel 40*b* are adjacently configured in a side-by-side relationship. Additionally, upwardly extending prongs 34*a* and downwardly extending prongs 35*a* may be disposed in front of cross wires of each respective facing panel. The vertical distance, X, from longitudinal wires 22*a*1-22*c*1 to cross wire 31*a*1 of facing panel 40*a* is defines the distance that the backfill can settle without longitudinal wires 22*a*1-22*c*1 of soil reinforcing element 25*a* bearing on cross wire 30*a*1.

Figure 14A:
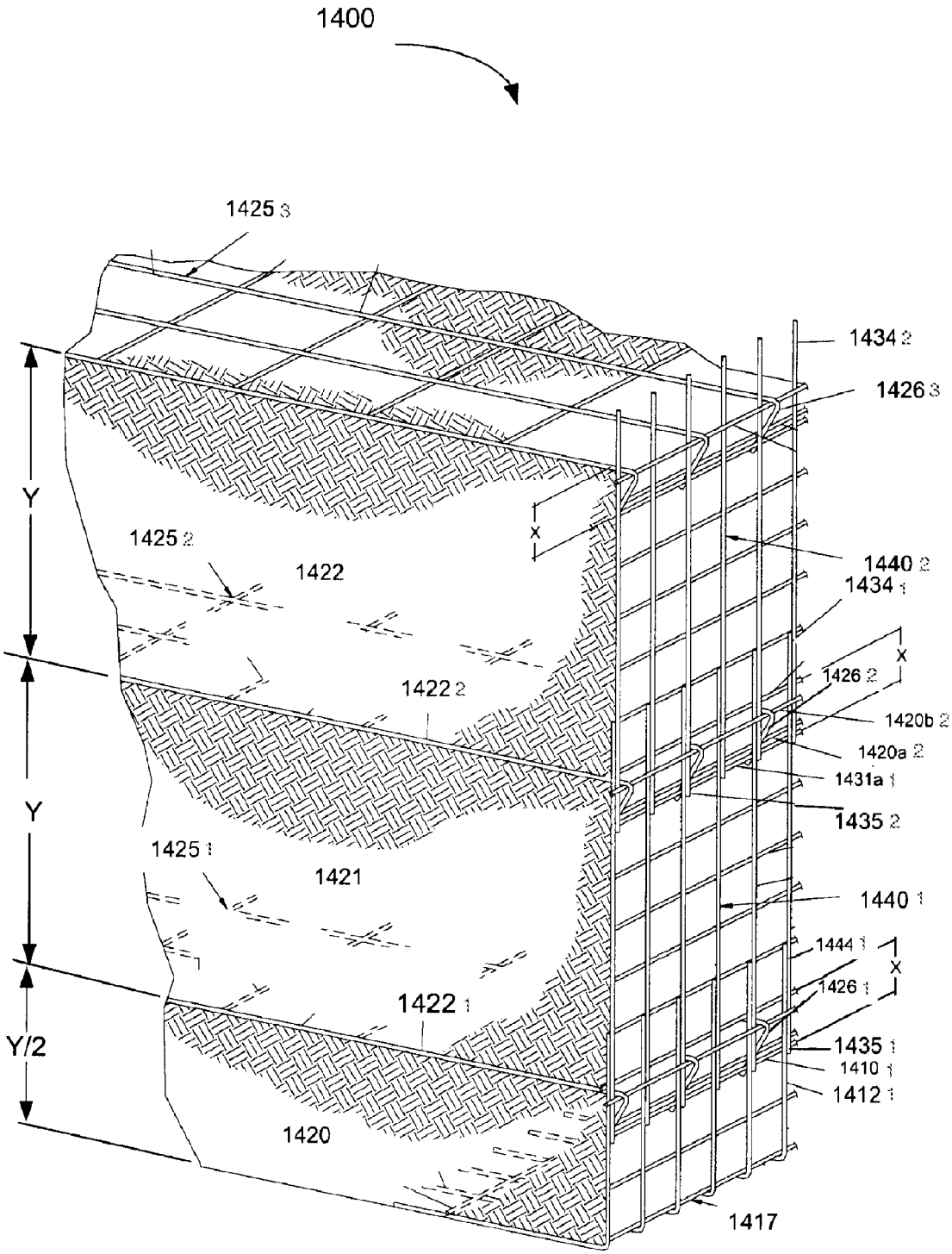
FIG. 14*a* is a diagrammatic isometric representation of an embodiment of a completed earthen formation.
Figure 14B:
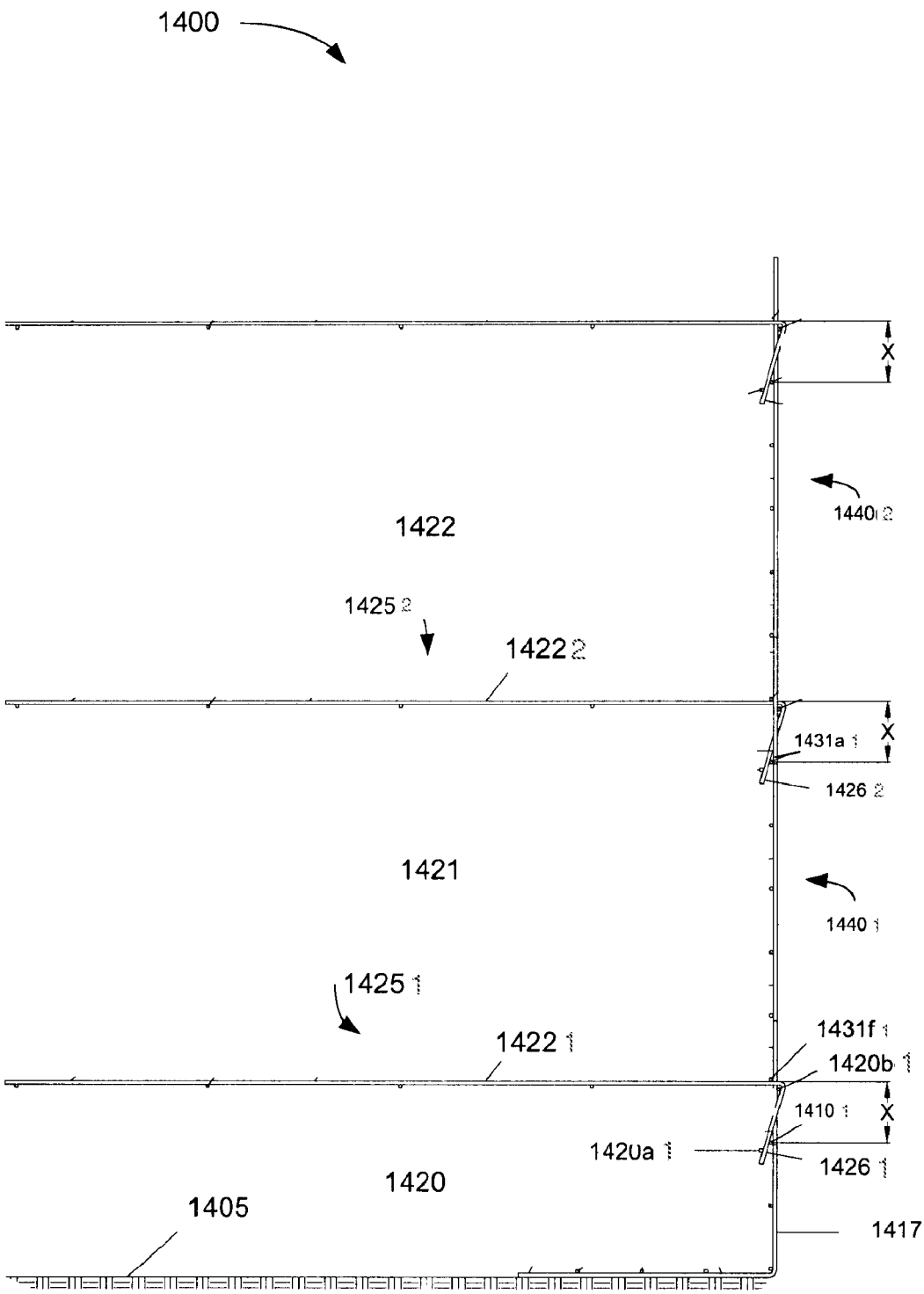
FIG. 14*b* is a side view of the earthen formation depicted in FIG. 14*a;*

FIG. 14*a* is a diagrammatic isometric representation of an embodiment of a completed earthen formation 1400 and FIG. 14*b* is a side view of the earthen formation depicted in FIG. 14*a*. Completed earthen formation 1400 shows a completed earthen formation comprising a foundation (FD) 1405, a first lift (L1) of soil reinforcing 1420, an intermediate lift (L2) of soil reinforcing 1421, and a top lift (L3) of soil reinforcing 1422.

Bottom face panel (BFP) 1417 is configured similar to BFP 17 shown and described in FIGS. 1-2 and 8-9 and is placed on a prepared foundation) 1405. Backfill is placed and compacted in a thickness equal to one-half the center-to-center spacing of the soil reinforcing first lift 1420. A bottom most soil reinforcing element 14251 (SR1) configured similar to SR 25 described with reference to FIGS. 2 and 5 is connected to the bottom facing panel 1417 by passing downwardly projecting section (PRSR1) 14261 of SR 14251 over the upwardly extending prongs (PRFP1) 14441 of BFP 1417. A lead transverse wire 1420*a*1 of SR 14251 is positioned aft of vertical wire 14121 of bottom facing panel 1417 and proximate a first cross wire 14101 of BFP 1417. A next soil reinforcing transverse wire 1420*b*1 is positioned in front of vertical wire 1412 of BFP 1417. The vertical spacing of the SR 14251 from foundation 1405 to the soil reinforcing longitudinal wire 14221 is one half of the center-to-center spacing of the soil reinforcing. LW 14221 is vertically disposed a distance "X" from the upper most cross wire 14101 of BFP 1417.

A next facing panel (FP1) 14401 configured similar to FP 40 described above is disposed in earthen formation 1400 by passing downwardly extending prongs (PR21) 14351 between soil reinforcing transverse wires 1420*a*1 and 1420*b*1 such that a bottom most cross wire 1431*f*1 of facing panel 14401 rests on LW 14221 of SR 14251. Backfill is placed and compacted in an intermediate lift L2 thickness equal to the center-to-center spacing of the soil reinforcing. A small void can be left at the back face of FP 14401 to help maintain FP 14401 in proper orientation until such time that the next soil reinforcing is placed over the upwardly extending prongs (PR1) 14341 of FP 14401. A next layer soil reinforcing element 14252 is placed on facing panel 14401 by passing the downwardly projecting section PRSR2 14262 over upwardly extending prongs (PR11) 14341. Lead transverse wire 1420*a*2 of SR 14252 is positioned laterally aft of vertical wires 14321 of facing panel 14401 and proximate a top cross wire 1431*a*1 of facing panel 14401. The next soil reinforcing transverse wire 1420*b*2 is positioned laterally forward of vertical wires 14321 of facing panel 14401. The vertical spacing of SR 14251 longitudinal wire 14221 to the next SR 14252 is equal to the center-to-center spacing of the soil reinforcing elements. LW 14222 is spaced a distance "X" from the top cross wire 143l*a*(1) of facing panel FP) 14401.

The process of cooperatively placing a facing panel and soil reinforcing element may be continued until the top of the wall elevation is reached. The top of the wall soil reinforcing is attached as in all other steps. The top most facing panel (FP2 14402 in the illustrative example) may have distal ends 14342 bent over an uppermost soil reinforcing soil reinforcing element 14253 or may be left extending upward.

Figure 15A:
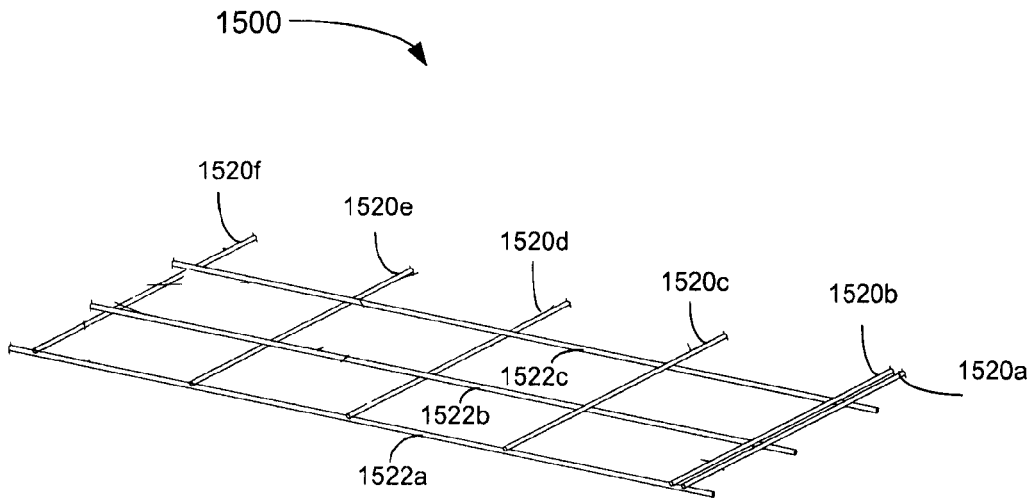
FIGS. 15*a* and 15*b* are respective isometric and side views of another embodiment of a soil-reinforcing element.
Figure 15B:
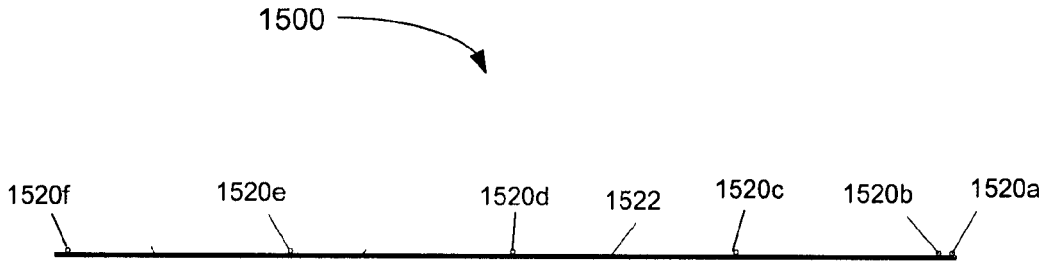
Figure 16A:
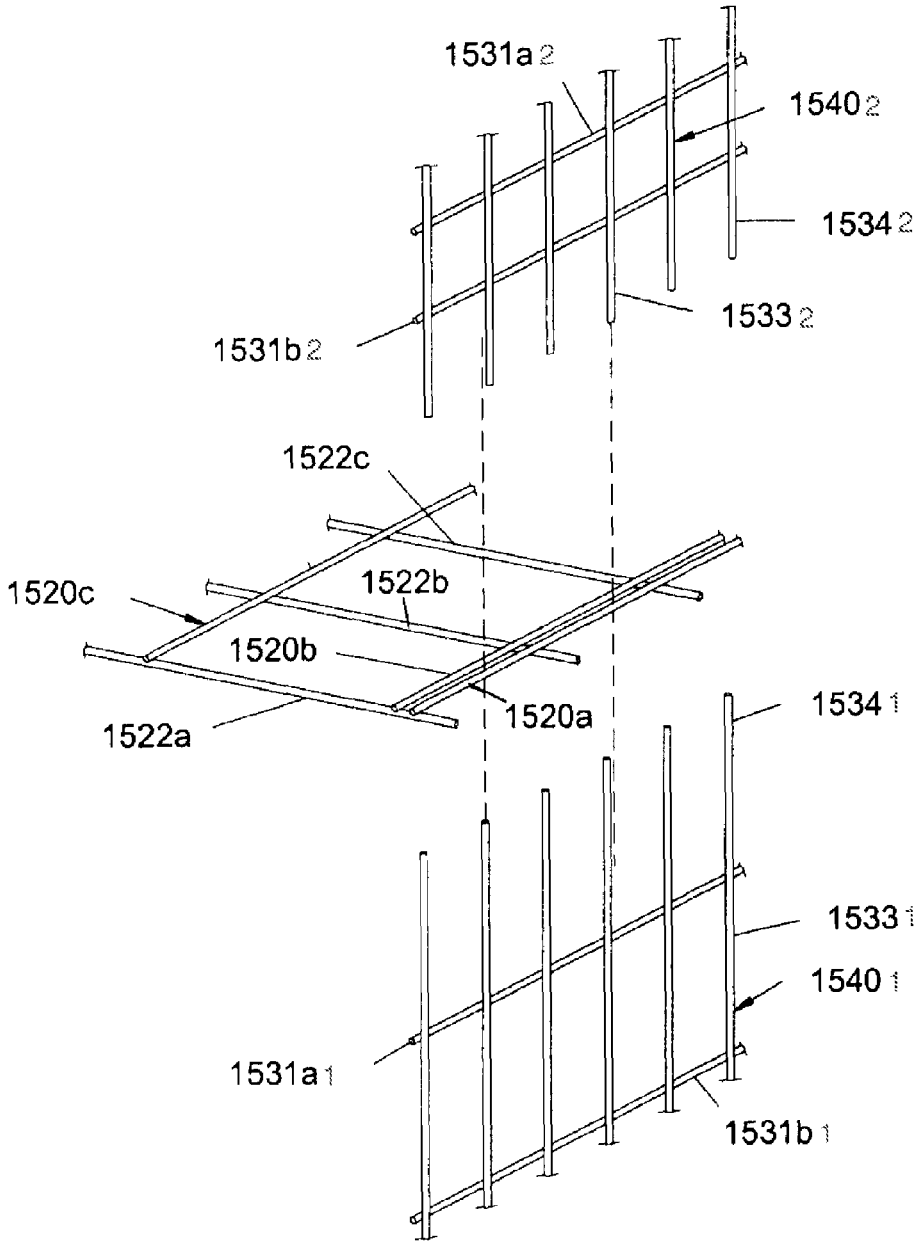
FIGS. 16*a-d* are respective diagrammatic representations of an exploded isometric view of another embodiment of a soil reinforcing element, an exploded side view of the soil reinforcing element, an isometric view of a section of the soil reinforcing assemblage in a final position in a mechanically stabilized earth structure, and a side view of a section of the soil reinforcing assemblage in the final position in which the soil reinforcing assemblage is implemented with a soil reinforcing element configured similar to the soil reinforcing element depicted in FIGS. 15A and 15B.
Figure 16B:
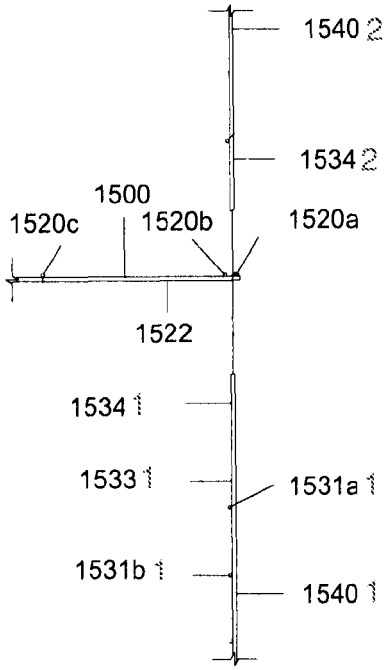
Figure 16C:
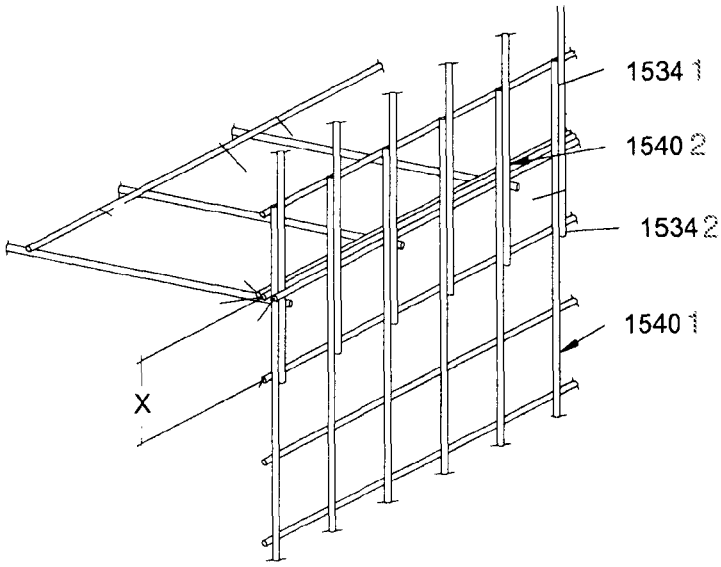
Figure 16D:
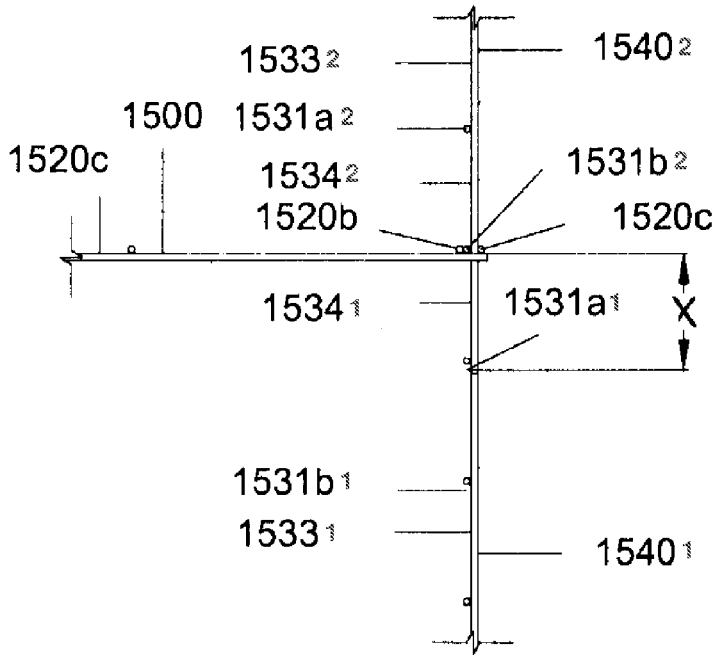

FIGS. 15*a* and 15*b* are respective isometric and side views of another embodiment of a soil-reinforcing (SR) 1500 element. SR 1500 is fabricated of welded wire mesh with longitudinal wires (LWs) 1522*a*-1522*c* (collectively referred to as LWs 1522) and transverse wires (TWs) 1520*a*-1520*f* (collectively referred to as TWs 1520) that are mechanically welded to each other at intersecting points. LWs 1522 are substantially perpendicular to the face of the earthen formation and TWs 1520 are substantially parallel to the face of the earthen formation. Preferably, SR 1500 comprises at least two LWs 1522 and may contain many LWs in other embodiments. The number of LWs included in SR 1500 is dependent on the fabricating tolerances of the wire manufacturer. The preferred wire-to-wire spacing between adjacent LWs is approximately 8" but may vary depending on the earthen structure use. SR 1500 includes a lead TW 1520*a*, and a succeeding transverse wire 1520*b*. The preferred spacing distance between TWs 1520*a* and 1520*b* may be the diameter of cross wires or vertical wires used in fabrication of the facing panel.

FIGS. 16*a*-*d* are, respectively, a diagrammatic representation of an exploded isometric view of another embodiment of a soil reinforcing element 1500, an exploded side view of soil reinforcing element 1500, an isometric view of a section of the soil reinforcing assemblage in a final position, and a side view of a section of the soil reinforcing assemblage in the final position in which the soil reinforcing assemblage is implemented with a soil reinforcing element configured similar to SR 1500 described in FIGS. 15A and 15B. These figures show the connection of facing panels 15401 and 15402 to soil-reinforcing element 1500. A soil-reinforcing opening between a first transverse wire 1520*a* and a next transverse wire 1520*b* is placed over the upwardly projecting distal ends of facing panel 15401. The lead cross wire 1520*a* of soil reinforcing element 1500 is placed in front of upwardly projecting prong 15341 of facing panel 15401 and the next cross wire 1520*b* of soil reinforcing element 1500 is placed behind the upwardly projecting prong 15341 of facing panel 15401. The upper facing panel 15402 is connected to the soil reinforcing element 1500 by passing the downwardly projecting distal end 15342 so it is in front of the soil reinforcing cross wire 1520*b* and behind soil reinforcing cross wire 1520*a*, and in front of the facing panel 15401 cross wire 1532*a*1. The cross wire 1531*b*2 of the upper facing panel 15402 rests on the longitudinal wires 1522 of the soil reinforcing element 1500. The position of the vertical wires 15331 and 15332 are such so the prongs 15341 and 15342 are in a side-by-side relationship and are in front of the cross wires 15311 and 15312 of each respective facing panel. The distance from the longitudinal wires 1522 to cross wire 1532*a*1 of the lower facing panel is illustratively designated as "X" and is the distance that the backfill can settle without the longitudinal wires 1522 of soil reinforcing element 1500 bearing on the cross wire 1532*a*1.

Figure 17A:
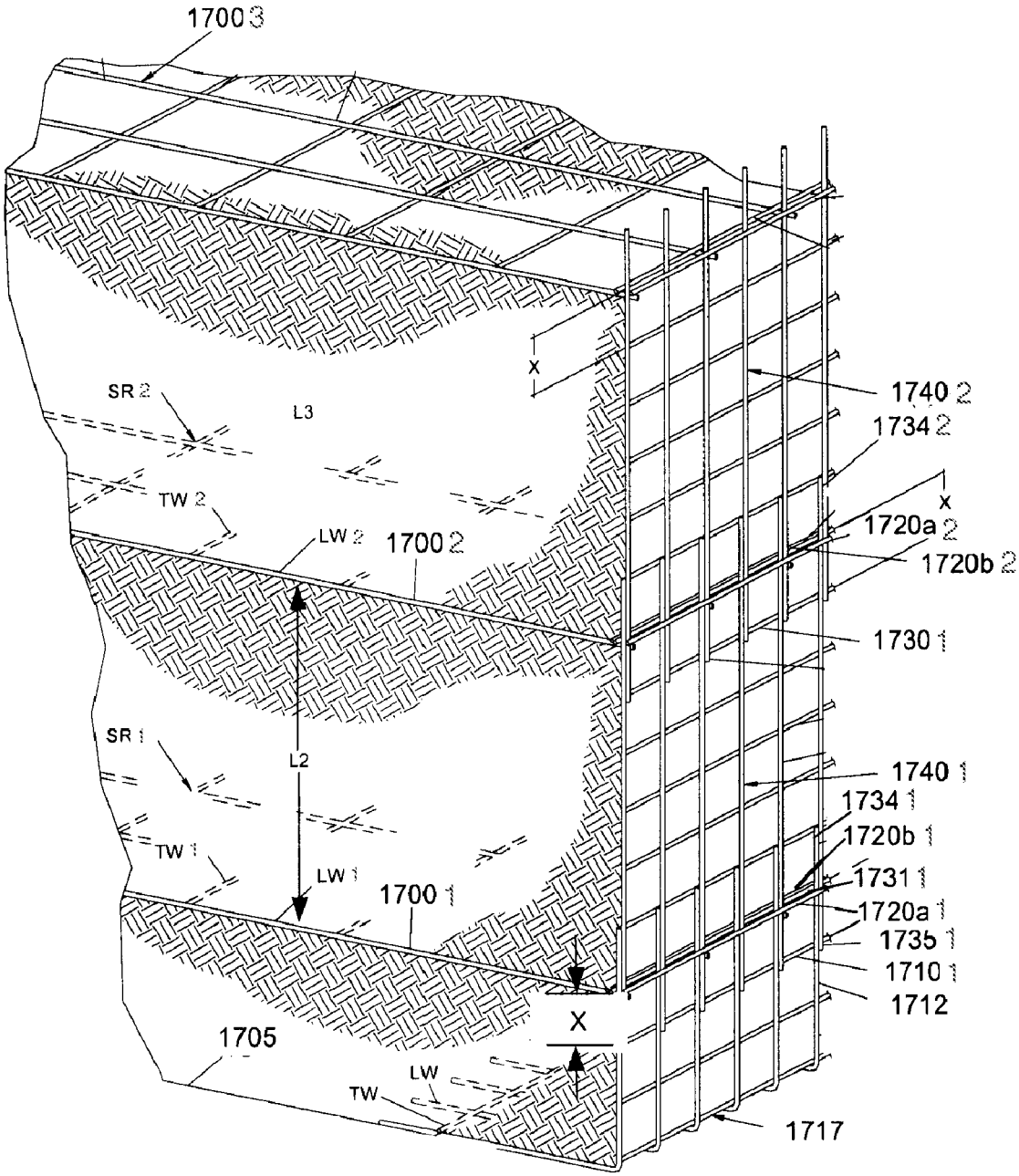
FIG. 17*a* depicts an isometric view of an embodiment of a mechanically stabilized earth structure implemented with soil reinforcing elements fabricated similar to soil reinforcing element 1500 depicted in FIG. 15.
Figure 17B:
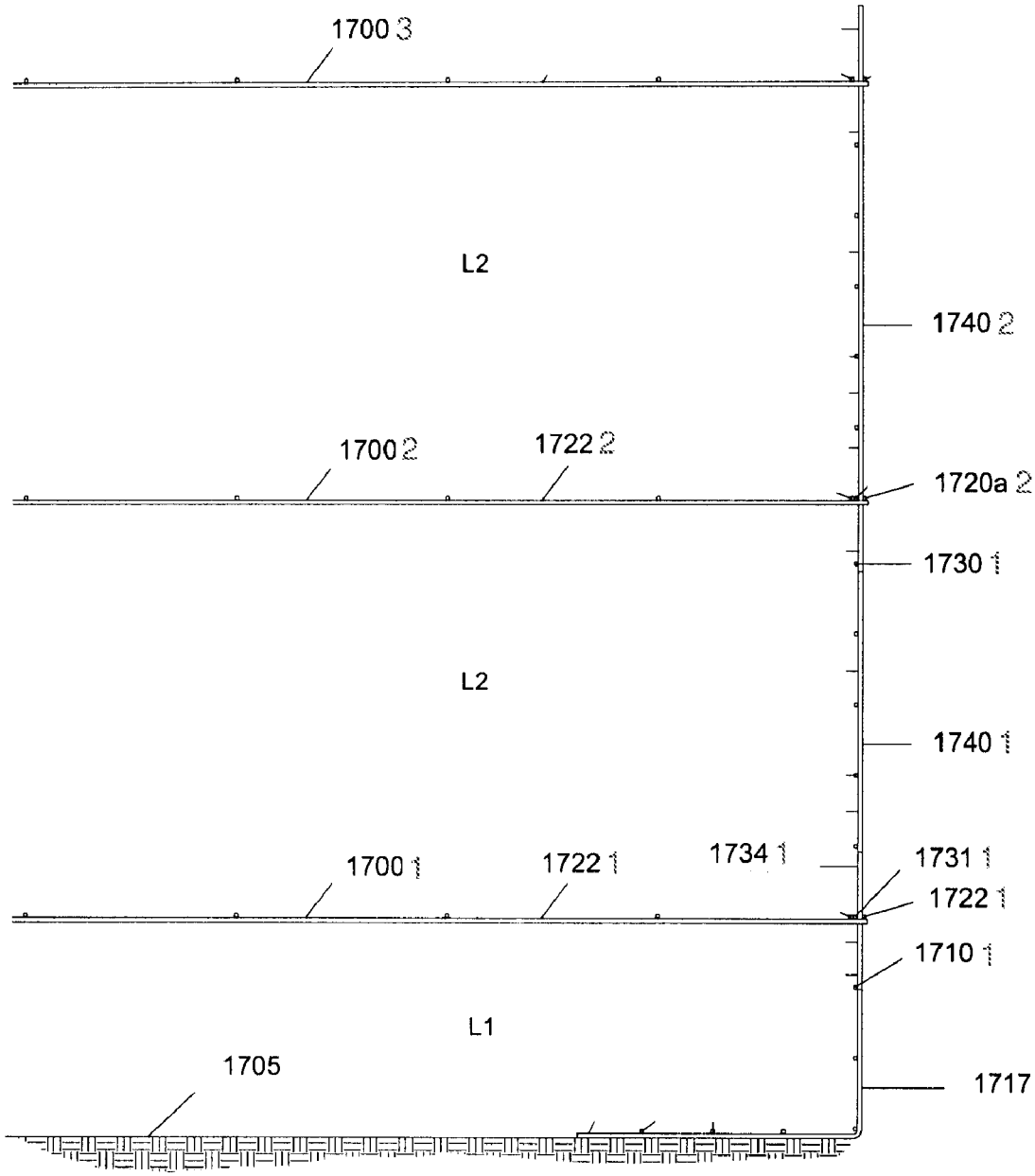
FIG. 17*b* is a sectional view of the mechanically stabilized earth structure depicted in FIG. 17*a;*

FIG. 17*a* depicts an isometric view of an embodiment of an MSE implemented with soil reinforcing elements fabricated similar to soil reinforcing element 1500 depicted in FIG. 15, and FIG. 17*b* is a sectional view of the MSE depicted in FIG. 17*a*. These two figures show a completed earthen formation comprising a foundation 1705, a first lift of soil reinforcing designated L1, an intermediate lift of soil reinforcing designated L2 and the top of wall soil reinforcing lift designated as L3.

Bottom face panels 1717 are placed on prepared foundation 1705. Backfill is placed and compacted in a thickness equal to one-half the center-to-center spacing of the soil reinforcing, designated as L1. A bottom most soil reinforcing element 17001 rests on the backfill of L1 and is connected to bottom facing panel 1717 by passing the lead end of soil reinforcing element 17001 over the upwardly extending prongs 17341 of BFP 1717. The lead transverse wire 1720*a*1 of soil reinforcing element 17001 is positioned in front of the vertical wires 1712 of bottom facing panel 1717. The next soil reinforcing transverse wire 1720*b*1 is positioned behind vertical wires 1712 of bottom facing panel 1717. The vertical spacing of soil reinforcing element 17001 from foundation 1705 to the soil reinforcing (SR1) longitudinal wire (LW1) is one half of the center-to-center spacing of the soil reinforcing. The longitudinal wire is spaced a distance "X" from the upper most cross wire 1710 of facing panel 1717.

Facing panel 17401 is placed by passing the downwardly extending prongs 17351 in front of soil reinforcing transverse wire 1720*b*1 and behind soil reinforcing transverse wire 1720*a*1 so the bottom most cross wire 17311 of facing panel 17401 rests on the longitudinal wires 17221 and between transverse wires 1720*a*1 and 1720*b*1 of soil reinforcing element 17001. Backfill is placed and compacted in a lift thickness (L2) equal to the center-to-center spacing of the soil reinforcing elements. A small void can be left at the back face of the panel to help keep the facing in proper orientation until such time that the next soil reinforcing is placed over the upwardly extending prongs 17342. The next layer of soil reinforcing is supported on the backfill and over facing panel 17401 by passing the lead end of soil reinforcing element 17002 over the upwardly extending prongs 17342. The lead transverse wire 1720*a*2 of soil reinforcing element 17002 is positioned in front of vertical wires of facing panel 17401. The next soil reinforcing transverse wire 1720*b*2 is positioned behind the vertical wires of facing panel 17401. The vertical spacing of the soil reinforcing from the lower layer of the soil reinforcing longitudinal wire to the next layer of soil reinforcing is equal to the center-to-center spacing of the soil reinforcing element. The longitudinal wire is spaced a distance "X" from the upper most cross wire 17301 of facing panel 17401.

The process of placing the facing panel and soil reinforcing is continued until the top of the wall elevation is reached. The top of the wall soil reinforcing is attached as in all other steps. The top most facing panel 17402 can have the distal ends bent over the soil reinforcing element 17003 lead transverse wire or they may be left extending upward.

Figure 18A:
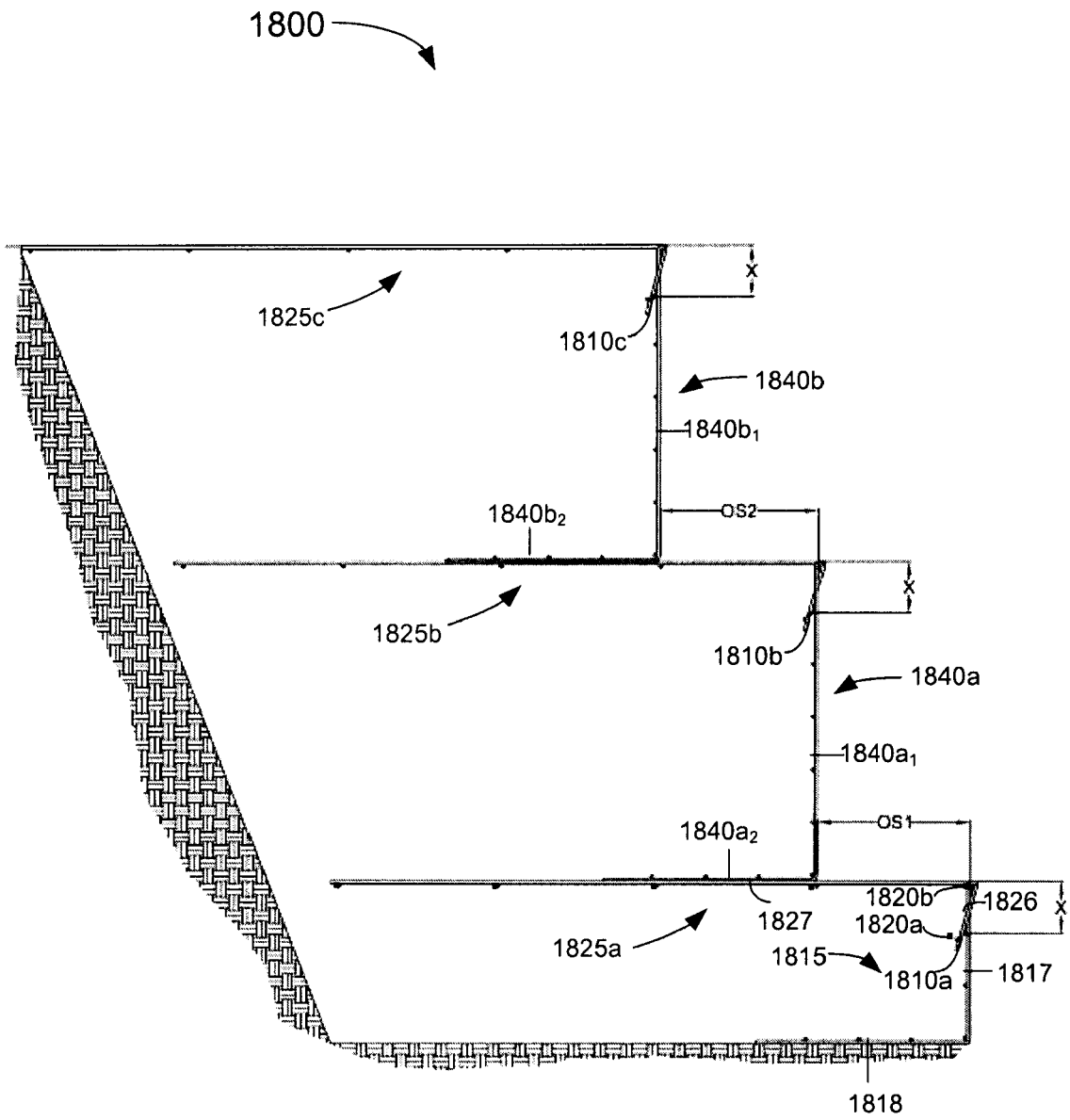
FIG. 18*a* is a diagrammatic representation of an alternative configuration of a Mechanically Stabilized Earth structure implemented in accordance with an embodiment.

FIG. 18*a* is a diagrammatic representation of an alternative configuration of a Mechanically Stabilized Earth structure 1800 implemented in accordance with an embodiment. A bottom facing element is fabricated into an L-shape component 1815 that is placed on a prepared foundation. L-shape component 1815 comprises a facing panel 1817 and a soil-reinforcing element 1818. Backfill is then placed and compacted to an elevation of the required spacing of the first soil-reinforcing element generally as described hereinabove with reference to the various embodiments. A slight wedge shaped void may be left at a back, or interior, face of facing panel 1817.

A soil reinforcing element 1825*a* is then disposed in the MSE structure. Soil reinforcing element 1825*a* may comprise a horizontal soil reinforcing section 1827 connected or otherwise integrated with a downwardly projecting section (PRSR) 1826 that is placed over distal ends of facing panel 1817 disposed therebelow. SR 1825*a* includes a plurality of transverse wires including a lead transverse wire 1820*a* and a succeeding transverse wire 1820*b*. Lead transverse wire 1820*a* is located more proximate to an end of PRSR 1826 than succeeding wire 1820*b*. The distal ends of facing panel 1817 are placed through PRSR 1826 so lead transverse wire 1820*a* is disposed at the back, or interior, face of facing panel 1817. Succeeding transverse wire 1820*b* is placed at the front, or exterior, face of the distally extending ends of facing panel 1817. A top most cross wire 1810*a* of facing panel 1817 in relation to the horizontally positioned soil-reinforcing element 1825*a* is a distance "X" below the elevation of SR 1825*a*. Horizontal section 1827 of SR 1825*a* may be completely supported on backfill and is not in contact with any cross element of facing panel 1817 disposed therebelow. Thus, the backfill may support SR 1825*a* such that horizontal section 1827 of SR 1825*a* does not bear on facing panel 1817 therebelow.

Figure 18B:
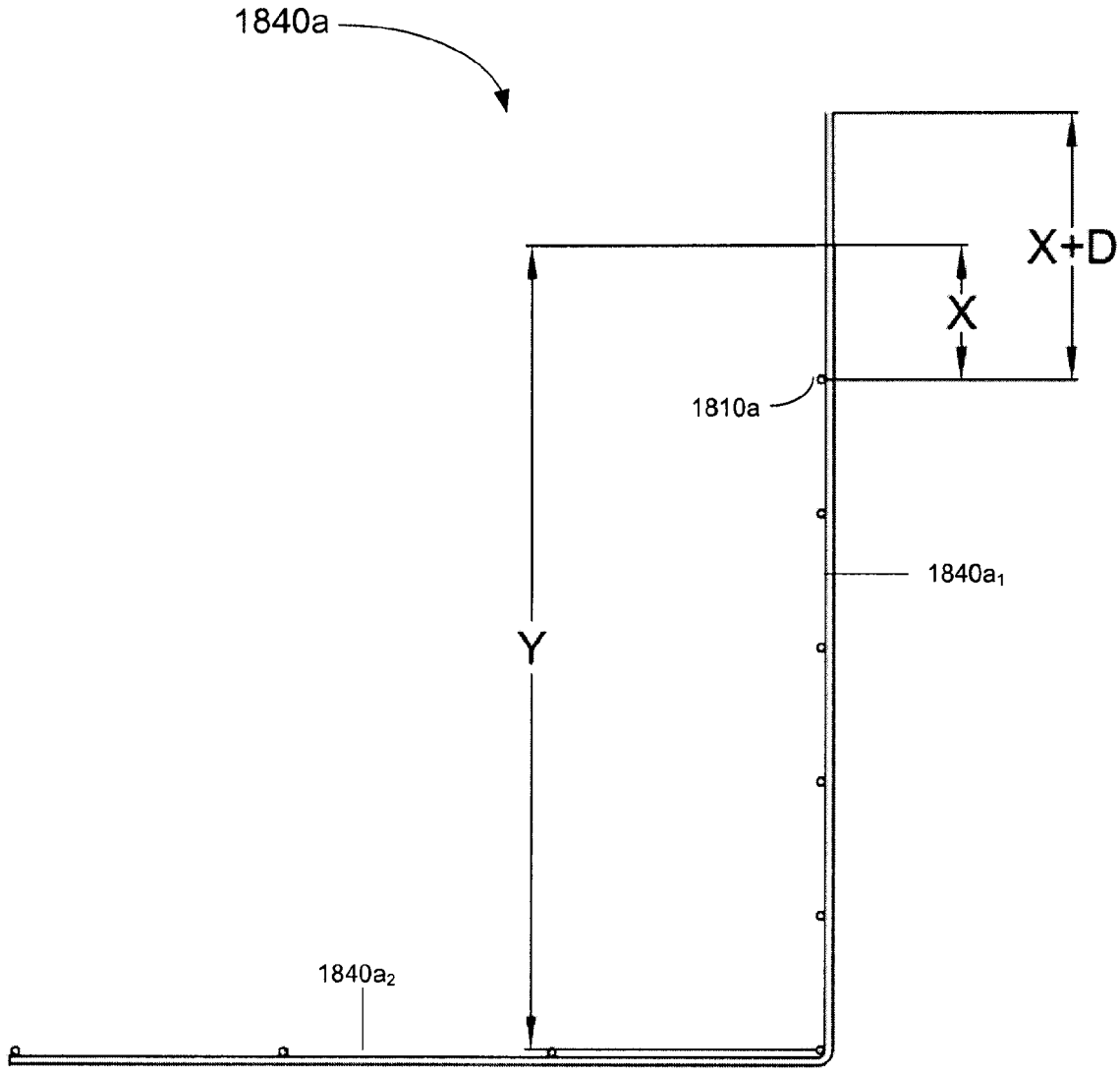
FIG. 18*b* is a diagrammatic representation of a facing panel that may be disposed in the MSE structure of FIG. 18*a;*

A facing panel 1840*a* generally configured as depicted in FIG. 18*b* may then be disposed in MSE structure 1800 and connected therewith by coupling facing panel 1840*a* with a soil reinforcing element 1825*b* disposed thereabove. In the present example, facing panel 1840*a* may comprise an L-shaped element that includes both a facing panel section 1840$a_1$ and a soil reinforcing section 1840$a_2$. A top most cross wire 1810*a* in relation to the horizontally positioned soil-reinforcing element 1825*b* is a distance "X" below the elevation of soil reinforcing element 1825*b*. The above-described assembly steps may be repeated until the top of the structure elevation is reached. In the present example, MSE structure 1800 includes an additional facing panel 1840*b* comprising a facing panel section 1840$b_1$ and a soil reinforcing section 1840$b_2$ and a SR 1825*c* assembled in a manner similar to that described with regard to facing panel 1840*a* and SR 1825*b*. Notably, in the present illustrative example, one or more of facing panels 1840*a*-1840*b* and soil reinforcing elements 1825*b*-1825*c* may be staggered, or offset, such that the MSE structure features a "stair-step" configuration. In the present example, facing panel section 1840$a_1$ is laterally offset from facing panel 1817 by a distance "OS1", and facing panel section 1840$a_2$ is laterally offset from facing panel section 1840$a_1$ by a distance "OS2".

Figure 19A:
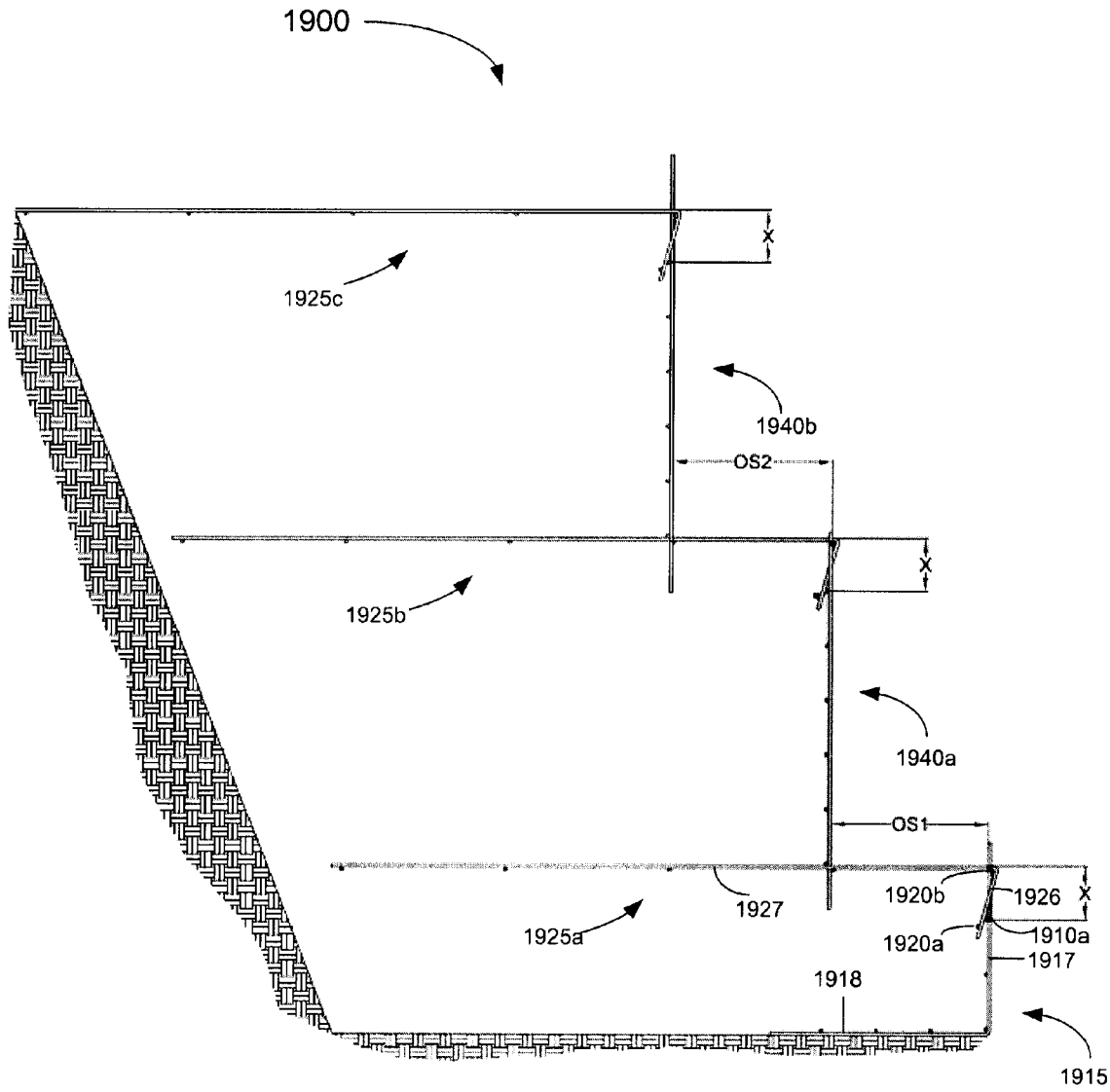
FIG. 19*a* is a diagrammatic representation of a staggered Mechanically Stabilized Earth structure featuring vertical facing panels implemented in accordance with an embodiment.

In accordance with another embodiment, a staggered Mechanically Stabilized Earth structure 1900 may feature vertical facing panels as depicted in FIG. 19*a*. A bottom facing element is fabricated into an L-shape component 1915 that is placed on a prepared foundation. L-shape component 1915 comprises a facing panel 1917 and a soil-reinforcing element 1918. Backfill is then placed and compacted to an elevation of the required spacing of the first soil-reinforcing element generally as described hereinabove with reference to the various embodiments. A slight wedge shaped void may be left at a back, or interior, face of face panel 1917.

A soil reinforcing element 1925*a* is then disposed in the MSE structure. Soil reinforcing element 1925*a* may comprise a horizontal soil reinforcing section 1927 connected or otherwise integrated with a downwardly projecting section (PRSR) 1926 that is placed over distal ends of facing panel 1917 disposed therebelow. SR 1925*a* includes a plurality of transverse wires including a lead transverse wire 1920*a* and a succeeding transverse wire 1920*b*. Lead transverse wire 1920*a* is located more proximate to an end of PRSR 1926 than succeeding transverse wire 1920*b*. The distal ends of facing panel 1917 are placed through PRSR 1926 so lead transverse wire 1920*a* is disposed at the back, or interior, face of facing panel 1917. Succeeding transverse wire 1920*b* is placed at the front, or exterior, face of the distally extending ends of facing panel 1917. A top most cross wire 1910*a* of facing panel 1917 in relation to the horizontally positioned soil-reinforcing element 1925*a* is a distance "X" below the elevation of SR 1925*a*. Horizontal section 1927 of SR 1925*a* may be completely supported on backfill and is not in contact with any cross element of facing panel 1917 disposed therebelow. Thus, the backfill may support SR 1925*a* such that horizontal section 1927 of SR 1925*a* does not bear on facing panel 1917 therebelow.

Figure 19B:
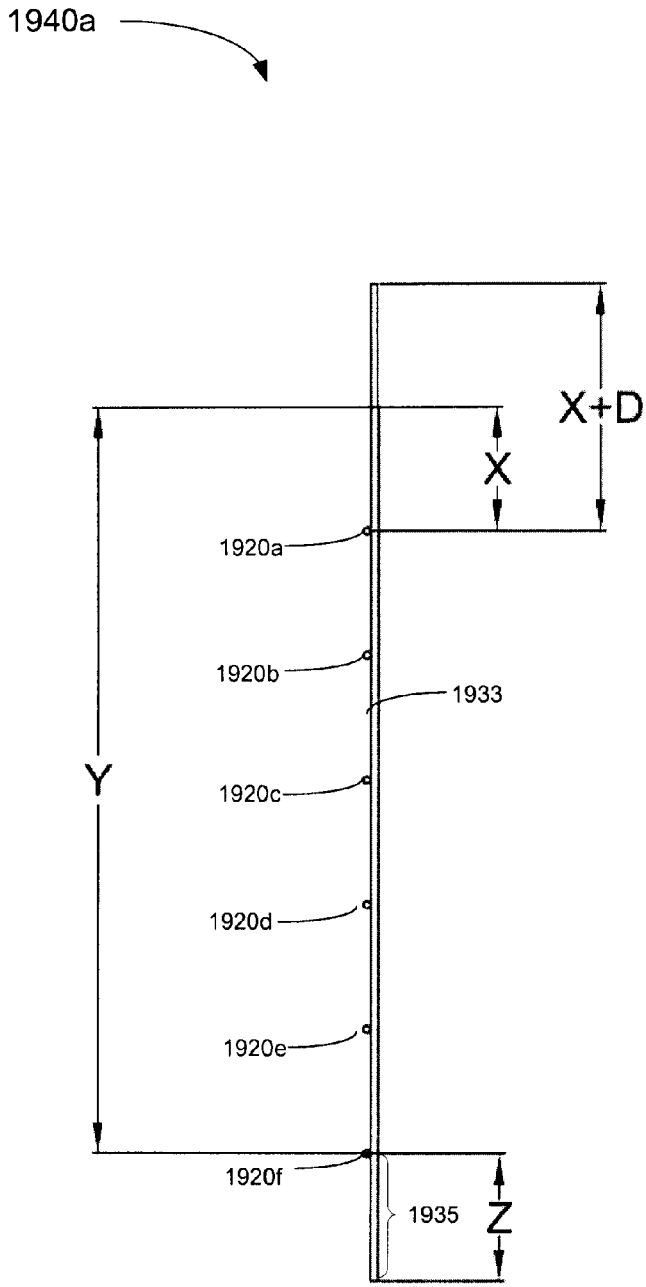
FIG. 19*b* is a diagrammatic representation of a linear facing panel that may be disposed in the MSE structure depicted in FIG. 19*a;*

A substantially linear facing panel 1940*a* generally configured as depicted in FIG. 19*b* may then be disposed in MSE structure 1900 and connected therewith by coupling facing panel 1940*a* with a soil reinforcing element 1925*b* disposed thereabove in a manner similar to the coupling of SR 1925*a* with facing panel 1917. In the present example, facing panel 1940*a* comprise a linear element substantially vertically disposed in MSE structure 1900 comprising a welded wire mess of cross wires 1920*a*-1920*f* and vertical wires 1933. A top most cross wire 1920*a* in relation to the horizontally positioned soil-reinforcing element 1925*b* is a distance "X" below the elevation of soil reinforcing element 1925*b*. Additionally, facing panel 1940*a* is coupled with SR 1925*a* disposed therebelow, in addition to SR 1925*b* thereabove, by piercing downwardly extending prongs 1935 comprising sections of vertical wires 1933 that extend below a bottom cross wire 1920*f* through the wire mesh of SR 1925*a*. Thus, prongs 1935 may extend a distance Z below the horizontal of SR 1925*a*, where Z is the length of prongs 1935 measured from a distal end thereof to bottom-most cross wire 1920*f*.

The above-described assembly steps may be repeated until the top of the structure elevation is reached. In the present example, MSE structure 1900 includes an additional facing panel 1940*b* and an SR 1925*c* assembled in a manner similar to that described with regard to facing panel 1940*a* and SR 1925*b*. The bottom-most facing panel 1917 and facing panels 1940*a*-1940*b* may be staggered, or offset, such that the MSE structure 1900 features a "stair-step" configuration. In the present example, facing panel section 1940*a* is laterally offset from facing panel 1917 by a distance "OS1", and facing panel 1940*b* is laterally offset from facing panel 1940*a* by a distance "OS2".

Figure 20A:
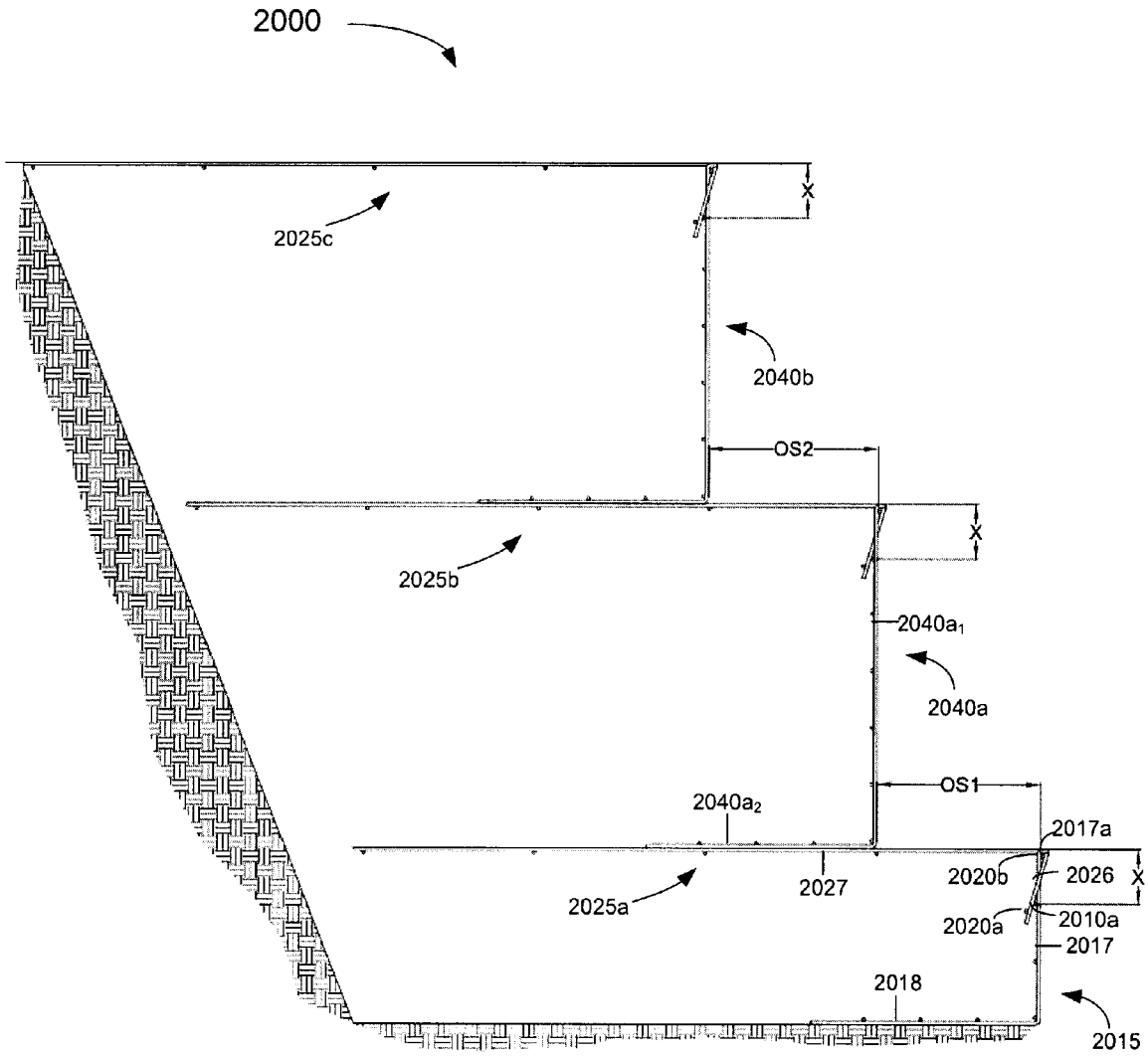
FIG. 20*a* is a diagrammatic representation of a staggered Mechanically Stabilized Earth structure featuring L-shaped facing panels with a distal end that extends to the exterior of the facing panel implemented in accordance with an embodiment.

In accordance with another embodiment, a staggered Mechanically Stabilized Earth structure 2000 may feature L-shaped facing panels with a distal end that extends to the exterior of the facing panel to better secure soil reinforcing elements as depicted in FIG. 20*a*. A bottom facing element is fabricated into a substantially L-shape component 2015 that is placed on a prepared foundation. Component 2015 comprises a facing panel 2017 and a soil-reinforcing element 2018. In the present exemplary embodiment, facing panel 2017 has distal ends 2017*a* that extend to the exterior of MSE structure 2000 as more clearly depicted in the diagrammatic representation of L-shaped component 2015 depicted in FIG. 20*b*. Backfill is then placed and compacted to an elevation of the required spacing of the first soil-reinforcing element generally as described hereinabove with reference to the various embodiments. A slight wedge shaped void may be left at a back, or interior, face of face panel 2017.

A soil reinforcing element 2025*a* is then disposed in the MSE structure. Soil reinforcing element 2025*a* may comprise a horizontal soil reinforcing section 2027 connected or otherwise integrated with a downwardly projecting section (PRSR) 2026 that is placed over distal ends of facing panel 2017 disposed therebelow. SR 2025*a* includes a plurality of transverse wires including a lead transverse wire 2020*a* and a succeeding transverse wire 2020*b*. Lead transverse wire 2020*a* is located more proximate to an end of PRSR 2026 than succeeding transverse wire 2020*b*. The distal ends of facing panel 2017 are placed through PRSR 2026 so lead transverse wire 2020*a* is disposed at the back, or interior, face of facing panel 2017. Succeeding transverse wire 2020*b* is placed at the front, or exterior, face of the distally extending ends of facing panel 2017. Succeeding transverse wire 2020*b* may be positioned in abutment, or in close proximity with, a juncture between facing panel 2017 and outwardly extending distal ends 2017*a* thereof thus providing enhanced coupling of SR 2025*a* with L-shaped component 2015. A top most cross wire 2010*a* of facing panel 2017 in relation to the horizontally positioned soil-reinforcing element 1925*a* is a distance "X" below the elevation of SR 2025*a*. Horizontal section 2027 of SR 2025*a* may be completely supported on backfill and is not in contact with any cross element of facing panel 2017 disposed therebelow. Thus, the backfill may support SR 2025*a* such that horizontal section 2027 of SR 2025*a* does not bear on facing panel 2017 therebelow.

Figure 20B:
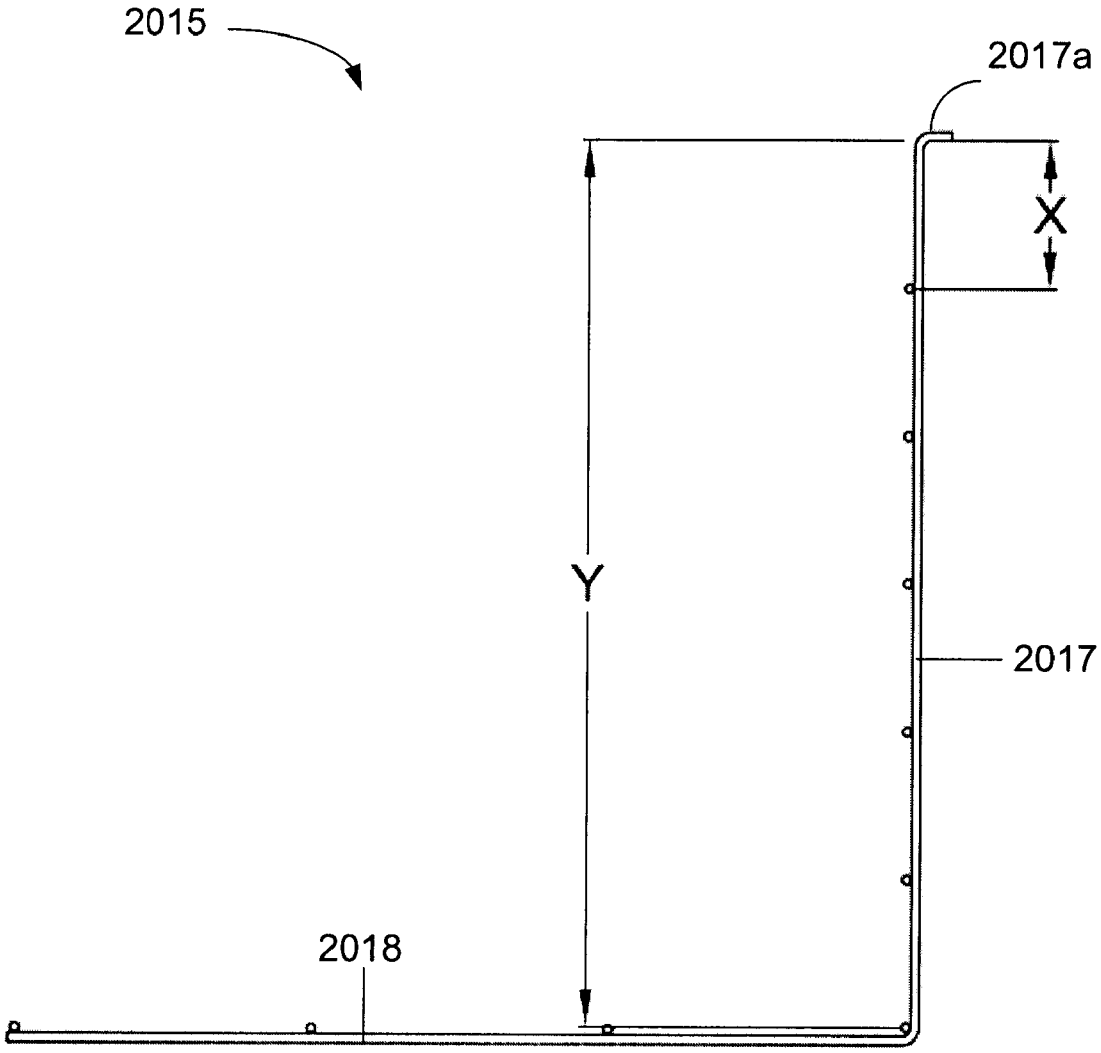
FIG. 20*b* is a diagrammatic representation of facing panel distal ends that extend to the exterior of an MSE structure in accordance with an embodiment.

A facing panel 2040*a* generally configured similar to L-shaped component 2015 depicted in FIG. 20*b* (though not necessarily dimensionally equivalent) may then be disposed in MSE structure 2000 and connected therewith by coupling facing panel 2040*a* with a soil reinforcing element 2025*b* disposed thereabove. In the present example, facing panel 2040*a* may comprise an L-shaped element that includes both a facing panel section 2040$a_1$ and a soil reinforcing section 2240$a_2$. A top most cross wire in relation to the horizontally positioned soil-reinforcing element 2025*b* is a distance "X" below the elevation of soil reinforcing element 2025*b*. SR 2025*b* may be coupled with facing panel 2040*a* in a manner similar to the coupling of SR 2025*a* with L-shaped component 2015.

The above-described assembly steps may be repeated until the top of the structure elevation is reached. In the present example, MSE structure 2000 includes an additional facing panel 2040*b* and an SR 2025*c* assembled in a manner similar to that described with regard to facing panel 2040*a* and SR 2025*b*. The bottom-most facing panel 2017 and facing panels 2040*a*-2040*b* may be staggered, or offset, such that the MSE structure 2000 features a "stair-step" configuration. In the present example, facing panel 2040*a* is laterally offset from facing panel 2017 by a distance "OS1", and facing panel 2040*b* is laterally offset from facing panel 2040*a* by a distance "OS2".

Figure 21:
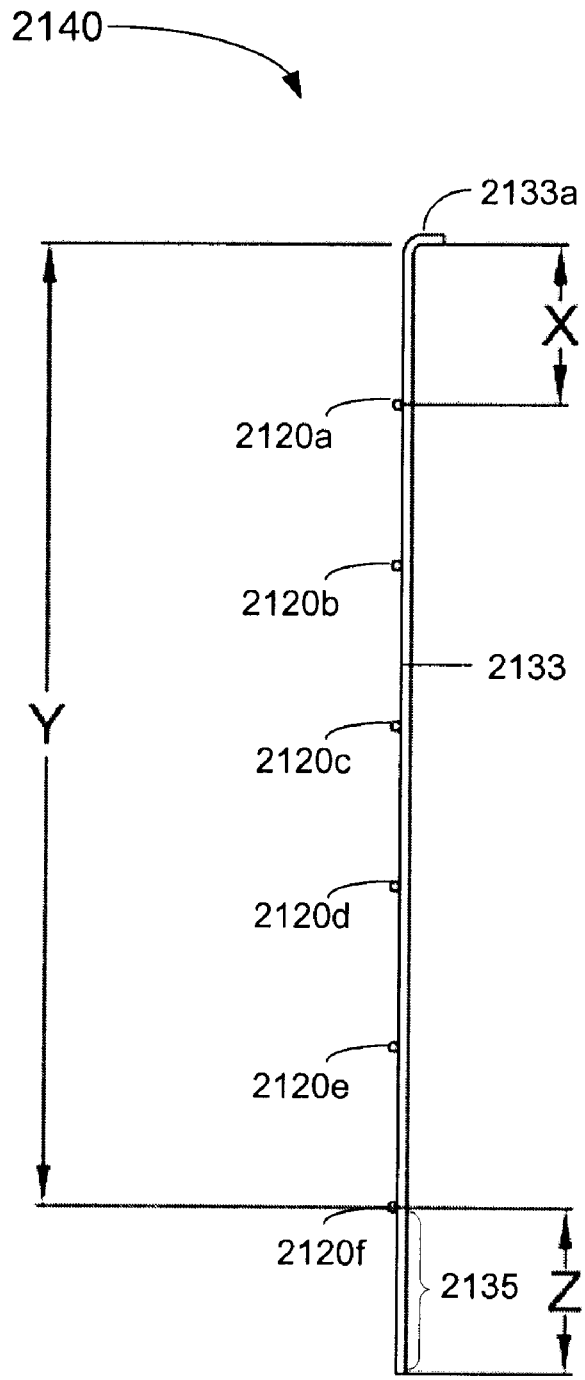
FIG. 21 is a diagrammatic representation of a substantially vertical facing panel comprising vertical wires and cross wires configured in a wire mesh that may be implemented as facing panels in an MSE structure in accordance with an embodiment.

In an alternative embodiment, a substantially vertical facing panel 2140 as depicted in FIG. 21 comprising vertical wires 2133 and cross wires 2120*a*-2120*f* configured in a wire mesh may be implemented as facing panels in an MSE structure. Facing panel 2140 may include a prong section 2133*a*, and facing panel 2140 may be deployed in an MSE structure such that prong section 2133*a* extends outwardly to the exterior of the MSE. An MSE similar to that depicted in FIG. 18 may be formed using facing panels implemented similar to facing panel 2140 substituted for facing panels 1840*a* and 1840*b*. In a similar manner, an MSE structure similar to that depicted in FIGS. 19 and 20 may be formed using facing panels implemented similar to facing panel 2140 substituted for facing panels 1940*a* and 1940*b* and 2040*a* and 2040*b*, respectively. In general, facing panel 2140 may be deployed in an MSE by piercing downwardly extending prongs 2135 comprising sections of vertical wires 2133 that extend below a lower most cross wire 2120*f* through a SR deployed therebelow such that prongs 2135 extend below an SR to a distance Z measured from distal ends of prongs 2135 to lower most cross wire 2120*f*. Facing panel 2140 may be secured with an SR disposed thereabove by placing distal ends of facing panel 2140 through PRSRs of an SR disposed thereabove such that a lead transverse wire of an SR is disposed at the back, or interior, face of facing panel 2140, and a succeeding transverse wire is placed at the front, or exterior, face of the distally extending ends of facing panel 2140. A succeeding transverse wire of an SR may be positioned in abutment, or in close proximity with, a juncture between vertical wires 2133 and outwardly extending distal ends 2133*a* of facing panel 2140.

Although embodiments of the present disclosure have been described in detail, those skilled in the art should understand that they may make various changes, substitutions and alterations herein without departing from the spirit and scope of the present disclosure.

Although embodiments of the present disclosure have been described in detail, those skilled in the art should understand that they may make various changes, substitutions and alterations herein without departing from the spirit and scope of the present disclosure. Accordingly, all such changes, substitutions and alterations are intended to be included within the scope of the present disclosure as defined in the following claims.

What is claimed is:

1. A soil reinforcing system, comprising:

a first soil reinforcing element comprising a plurality of longitudinal wires and a plurality of transverse wires substantially orthogonal to the longitudinal wires, wherein the plurality of transverse wires comprise a first transverse wire and a second transverse wire adjacent the first transverse wire, and the first soil reinforcing element further comprising a first section and a second section configured at an angle with respect to the first section; and a first facing panel comprising a plurality of vertical wires and a plurality of cross wires including a top-most cross wire configured substantially orthogonal to the vertical wires, wherein the first soil reinforcing element is engaged with the first facing panel proximate a juncture of the first section and the second section such that the first transverse wire is positioned interiorly and the second transverse wire is positioned exteriorly with respect to the first facing panel, and such that the first section is disposed vertically above the top-most cross wire.

2. The soil reinforcing system of claim 1, wherein the first facing panel comprises a bottom facing element and a soil reinforcing section configured substantially perpendicular to the bottom facing element.

3. The soil reinforcing system of claim 1, wherein the first transverse wire is disposed vertically below the top-most cross wire, and the second transverse wire is disposed vertically above the top-most cross wire.

4. The soil reinforcing system of claim 1, wherein the plurality of vertical wires extend vertically above a top-most cross wire of the first facing panel.

5. The soil reinforcing system of claim 1, further comprising a second facing panel comprising a second plurality of vertical wires and a second plurality of cross wires, wherein the second facing panel is disposed substantially parallel with the first facing panel.

6. The soil reinforcing system of claim 5, wherein the second facing panel includes a lower-most cross wire, and the second plurality of vertical wires extend vertically below the lower-most cross wire.

7. The soil reinforcing system of claim 6, wherein the first facing panel includes a top-most cross wire, and the second facing panel is disposed such that the second plurality of vertical wires interpose the top-most cross wire and the second transverse wire.

8. The soil reinforcing system of claim 5, wherein a bottom-most cross wire of the second plurality of cross wires engages the plurality of longitudinal wires of the first soil reinforcing element.

9. The soil reinforcing system of claim 5, wherein the second facing panel includes an upper-most cross wire, and the second plurality of vertical wires extend vertically above the upper-most cross wire.

10. The soil reinforcing system of claim 9, further comprising a second soil reinforcing element comprising a second plurality of longitudinal wires and a second plurality of transverse wires configured substantially orthogonal to the second plurality of longitudinal wires, wherein the second soil reinforcing element comprises a first section and a second section configured at an angle with respect to the first section of the second soil reinforcing element.

11. The soil reinforcing system of claim 10, wherein the second soil reinforcing element is engaged with the second facing panel proximate a juncture of the first and second sections of the second soil reinforcing element.

12. The soil reinforcing system of claim 11, wherein a first transverse wire of the second soil reinforcing element is positioned interiorly with respect to the second facing panel and a second transverse wire of the second soil reinforcing element is configured exteriorly with respect to the second facing panel.

13. The soil reinforcing system of claim 1, wherein the first facing panel comprises a soil reinforcing section and a bottom facing element disposed substantially orthogonal to the soil reinforcing section thereby substantially forming an L-shape, wherein the soil reinforcing section of the first facing panel is disposed substantially parallel with and vertically offset below the first section of the first soil reinforcing element, the system further comprising a second facing panel comprising a third section and a fourth section substantially orthogonal to the third section, wherein the third section is vertically offset and substantially parallel with the first section of the soil reinforcing element, and the fourth section is disposed substantially parallel with and laterally offset from the bottom facing element of the first facing panel.

14. The soil reinforcing system of claim 1, wherein the first facing panel comprises a soil reinforcing section and a bottom facing element disposed substantially orthogonal to the soil reinforcing section thereby substantially forming an L-shape, wherein the soil reinforcing section of the first facing panel is disposed substantially parallel with and vertically offset below the first section of the first soil reinforcing element, the system further comprising a substantially planar second facing panel that is substantially parallel with and laterally offset from the bottom facing element of the first facing panel, wherein the second facing panel comprises a second plurality of vertical wires and a second plurality of cross wires configured substantially orthogonal to the second plurality of vertical wires, and wherein the second facing panel is engaged with the first soil reinforcing element by extending the second plurality of vertical wires through the first section of the first soil reinforcing element such that a lower-most cross wire of the second plurality of cross wires abuts the plurality of longitudinal wires of the first soil reinforcing element.

15. The soil reinforcing system of claim 1, wherein the plurality of vertical wires extend vertically above a top-most cross wire, and wherein distal ends of the plurality of vertical wires are orthogonal to the plurality of vertical wires such that the distal ends extend outwardly.

16. A method of assembling a soil reinforcing system, comprising:

placing a first facing panel on a foundation, the first facing panel comprising a plurality of vertical wires and a plurality of cross wires including a top-most cross wire configured substantially orthogonal to the plurality of vertical wires, wherein the first facing panel is configured with a soil reinforcing section substantially perpendicular to a facing section, and wherein the plurality of vertical wires extend vertically above the top-most cross wire;

placing backfill on at least a portion of the soil reinforcing section; and placing and supporting a first soil reinforcing element entirely on the backfill, wherein the first soil reinforcing element comprises a plurality of longitudinal wires and a plurality of transverse wires including a lead transverse wire and an adjacent transverse wire, the first soil reinforcing element further comprising a first section and a second section configured at an angle with respect to the first section and including the lead and adjacent transverse wires, and wherein the plurality of vertical wires extend through the second section such that the lead transverse wire is interiorly disposed and the adjacent transverse wire is exteriorly disposed with respect to the first facing panel.

17. The method of claim 16, further comprising engaging a second facing panel with the first soil reinforcing element, wherein the second facing panel comprises a second plurality of vertical wires and a second plurality of cross wires, the second facing panel including a lower-most cross wire wherein the second plurality of vertical wires extends vertically below the lower-most cross wire, and the second facing panel is disposed such that the second plurality of vertical wires interpose the top-most cross wire of the first facing panel and the adjacent transverse wire.

18. The method of claim 17, further comprising:

sequentially engaging one or more intermediate soil reinforcing elements with a respective facing panel; and coupling a capping mat to a top-most facing panel.

* * * * *